US011415904B2

(12) United States Patent
Maeda

(10) Patent No.: US 11,415,904 B2
(45) Date of Patent: Aug. 16, 2022

(54) IMAGE FORMING METHOD AND IMAGE FORMING SYSTEM

(71) Applicant: Konica Minolta, Inc., Tokyo (JP)

(72) Inventor: Seisuke Maeda, Fussa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/201,507

(22) Filed: Mar. 15, 2021

(65) Prior Publication Data

US 2021/0318632 A1 Oct. 14, 2021

(30) Foreign Application Priority Data

Apr. 13, 2020 (JP) ..... JP2020-071752

(51) Int. Cl.

| | |
|---|---|
| ***G03G 9/097*** | (2006.01) |
| ***G03G 15/08*** | (2006.01) |
| ***G03G 9/08*** | (2006.01) |
| ***G03G 5/07*** | (2006.01) |
| ***G03G 5/147*** | (2006.01) |
| ***G03G 13/01*** | (2006.01) |

(52) U.S. Cl.

CPC ..... *G03G 9/09708* (2013.01); *G03G 5/0764* (2020.05); *G03G 5/14704* (2013.01); *G03G 5/14734* (2013.01); *G03G 5/14786* (2013.01); *G03G 5/14795* (2013.01); *G03G 9/0819* (2013.01); *G03G 13/013* (2013.01); *G03G 15/08* (2013.01)

(58) Field of Classification Search

CPC ..... G03G 9/09708; G03G 5/0764; G03G 9/0819; G03G 15/08; G03G 5/14704; G03G 5/14734; G03G 5/14786; G03G 5/14795; G03G 13/013

See application file for complete search history.

(56) References Cited

U.S. PATENT DOCUMENTS

| | | | | |
|---|---|---|---|---|
| 2018/0267416 | A1* | 9/2018 | Uchino | G03G 9/08797 |
| 2022/0011686 | A1* | 1/2022 | Kayamori | G03G 9/0926 |
| 2022/0057724 | A1* | 2/2022 | Maeda | G03G 5/047 |

FOREIGN PATENT DOCUMENTS

| | | | |
|---|---|---|---|
| JP | 05158250 | A * | 6/1993 |
| JP | 2012-128324 | A | 7/2012 |
| JP | 2014075347 | A * | 4/2014 |
| JP | 2014137446 | A * | 7/2014 |
| JP | 2018151516 | A * | 9/2018 |
| JP | 2019174589 | A * | 10/2019 |
| JP | 2021131520 | A * | 9/2021 |

OTHER PUBLICATIONS

EIC STIC Structure Search Report (dated Year: 2022).*

* cited by examiner

*Primary Examiner* — Ryan D Walsh
(74) *Attorney, Agent, or Firm* — Lucas & Mercanti, LLP

(57) ABSTRACT

Provided is an image forming method using a toner for developing an electrostatic charge image and an electrophotographic photoreceptor, and containing at least a charging step, an exposing step, a developing step and a transferring step, wherein the electrophotographic photoreceptor has a photosensitive layer, and the photosensitive layer contains a triphenylamine derivative having a specific structure as a charge transport material, and the toner for developing an electrostatic charge image contains at least titanic acid compound particles as an external additive.

10 Claims, 2 Drawing Sheets

IMAGE FORMING METHOD AND IMAGE FORMING SYSTEM

CROSS-REFERENCE TO RELATED APPLICATION

The entire disclosure of Japanese Patent Application No. 2020-071752 filed on Apr. 13, 2020 is incorporated herein by reference in its entirety.

BACKGROUND

Technological Field

The present invention relates to an image forming method and an image forming system. More specifically, the present invention relates to an image forming method and an image forming system capable of stably supplying a high-quality image even in long-term use because the photoreceptor can maintain high durability while maintaining both cleaning performance and memory performance.

Description of the Related Art

Recently, there has been a demand for an electrophotographic image forming system capable of providing high-quality printed matter at a higher speed in the electrophotographic system in the commercial printing field.

In an electrophotographic image forming system, image formation is performed through a charging step, an exposing step, a developing step, and a transferring step using an electrophotographic photoreceptor (hereinafter, also simply referred to as a "photoreceptor") and a toner for developing an electrostatic charge image (hereinafter, also simply referred to as a "toner"). Further, the photoreceptor after the transfer step is subjected to the next image formation through a cleaning step.

Electrical energy, optical energy, and mechanical force are supplied to the photoreceptor in each step such as charging, exposing, developing, transferring, and cleaning in forming an image. Therefore, the photoreceptor is required to have durability such that charge stability and potential retention are not impaired by repetition of image formation.

In particular, due to the increase in the above-described process speed, the load on the photoreceptor increases during cleaning of the toner, resulting in an increase in the amount of scratches and wear on the photoreceptor. Since the wear of the photoreceptor leads to decrease of the quality of the image, higher durability has become required for the photoreceptor.

It is also known that in the process of cleaning the toner from the photoreceptor, the magnitude of the non-electrostatic adhesion force on the surface of the photoreceptor affects the cleaning performance. Therefore, in order to improve the cleaning performance, it is known to form a surface layer of a material having a low friction property on the surface of the photoreceptor.

Further, as the process speed increases, the photoreceptor is required to have a higher response speed. Correspondingly, for example, Patent Document 1 (JP-A 2012-128324) discloses an invention in which a charge transport rate is improved while maintaining the surface strength of a photoreceptor by using a triphenylamine-based compound having a specific structure as a charge transport material.

However, although the addition of such a charge transport material has a certain effect on the memory characteristics, the durability tends to decrease. Specifically, there has been a problem that the photoreceptor is easily worn, cleaning failure of the toner occurs, and streak-like defects occur in the formed image.

On the other hand, an attempt has been made to form a resin protective layer having a three dimensional crosslinked structure by photocuring on a surface of a photoreceptor in view of high durability. The protective layer of the photocurable resin exhibits strength but is inferior in memory characteristics, and the addition of the charge transport material as described above is required to maintain the memory characteristics. As described above, since the addition of the charge transport material lowers the intensity of the photoreceptor, there is a problem that both of the durability and the memory characteristics cannot be realized.

SUMMARY

The present invention has been made in view of the above problems and circumstances. An object of the present invention is to provide an image forming method and an image forming system that may stably supply high-quality images even in long-term use by allowing an electrophotographic photoreceptor to maintain high durability while achieving both cleaning performance and memory performance in an image forming method using a toner for electrostatic charge image development and an electrophotographic photoreceptor.

In order to solve the above-mentioned problems, the present inventors have found the following in the process of examining the causes of the above-mentioned problems. That is, in an image forming method using the toner for electrostatic image development and the electrophotographic photoreceptor, since the electrophotographic photoreceptor has a photosensitive layer, the photosensitive layer contains a triphenylamine derivative having a specific structure as a charge transport material, and the toner for electrostatic image development contains at least titanic acid compound particles as an external additive, the photoreceptor may maintain high durability while maintaining both cleaning performance and memory performance. Thus, it has been found that an image forming method and an image forming system capable of stably supplying high-quality images even in long-term use may be provided, and the present invention has been achieved. In other words, the problem relating to the present invention is solved by the following means.

To achieve at least one of the above-mentioned objects, an image forming method that reflects an aspect of the present invention is as follows.

An image forming method using a toner for developing an electrostatic charge image and an electrophotographic photoreceptor and having at least a charging step, an exposing step, a developing step and a transferring step, wherein the electrophotographic photoreceptor has a photosensitive layer, and the photosensitive layer contains a compound having a structure represented by the following Formula (1) as a charge transport material, and the toner for developing an electrostatic charge image contains at least titanic acid compound particles as an external additive.

Formula (1)

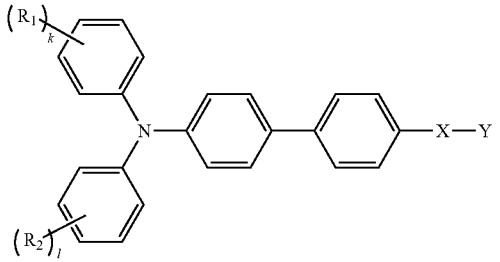

In Formula (1), $R_1$ and $R_2$ each independently represent an alkyl group having 1 to 7 carbon atoms or an alkoxy group having 1 to 7 carbon atoms; k and l each independently represent an integer of 0 to 5; X represents a single bond or an alkylene chain; Y represents a hydrogen atom, an alkyl group having 1 to 7 carbon atoms, an alkoxy group having 1 to 7 carbon atoms or a substituent having a reactive group; and $R_1$ may be the same or different when k is 2 or more, and $R_2$ may be the same or different when l is 2 or more.

According to the above-described means of the present invention, in an image forming method using a toner for developing an electrostatic charge image and an electrophotographic photoreceptor, it is possible to provide an image forming method and an image forming system that may stably supply a high-quality image even in a long-term use by allowing the electrophotographic photoreceptor to maintain high durability while achieving both cleaning performance and memory performance. The expression mechanism or action mechanism of the effect of the present invention is not clarified, but is inferred as follows.

In the image forming method of the present invention, the used photoreceptor contains a charge transport material having the structure represented by the above Formula (1) (hereinafter, also referred to as a charge transport material (1)) in the photosensitive layer of the photoreceptor, whereby the memory performance is ensured. Further, since the used toner contains titanic acid compound particles as an external additive, an image forming method in which the charging amount of the toner is controlled and the cleaning performance is excellent may be provided.

The amount of charging of the toner may be controlled by holding the external additive in the toner. In the present invention, as the external additive, titanic acid compound particles are used to control the amount of charge of the toner to be small, thereby weakening the adhesion of the toner to the photoreceptor and ensuring the wiping performance at the time of cleaning. As a result, the direct damage to the photoreceptor is reduced, and the occurrence of filming due to the decrease of the adhering force on the photoreceptor is suppressed, and the effect of preventing white spots in the halftone image is obtained as the image quality.

Note that the above skeleton (skeleton in which a benzene ring is bonded to 1 of phenyl groups of triphenylamine) possessed by the charge transport material (1) is a structure having transparency to light rays while sufficiently exhibiting memory characteristics. When a photopolymerizable resin is used as a binder resin in forming a photosensitive layer, in the skeleton of the charge transport material (1), since the photopolymerization initiator hardly absorbs light rays to be absorbed, curing of the binder resin is hardly inhibited. Therefore, in particular, when the photosensitive layer is composed of a photopolymerizable resin, the effect of using the charge transport material (1) becomes more remarkable.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
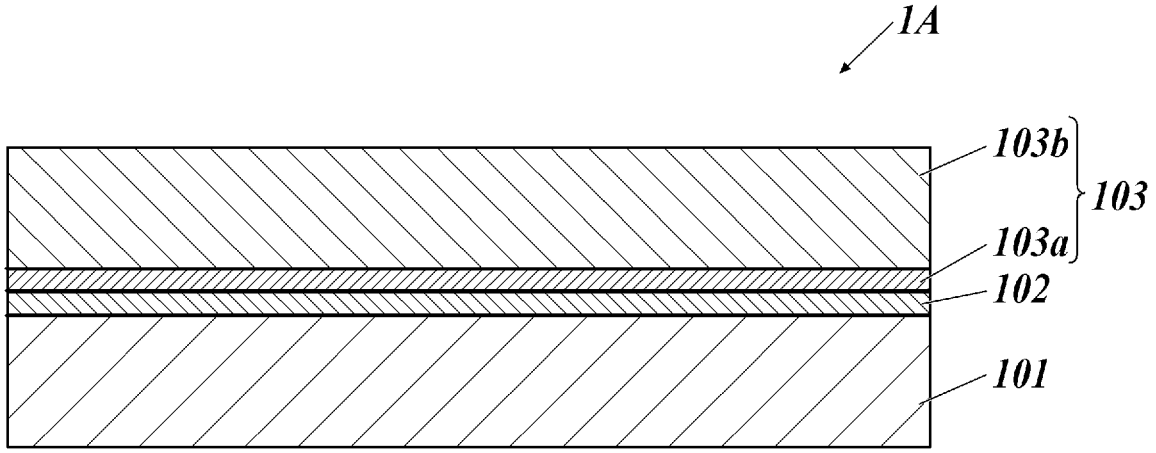
FIG. 1 is a cross-sectional view showing an example of a layer configuration of an electrophotographic photoreceptor according to the present invention.

Hereinafter, one or more embodiments of the present invention will be described. However, the scope of the invention is not limited to the disclosed embodiments.

The image forming method of the present invention is an image forming method using a toner for developing an electrostatic charge image and an electrophotographic photoreceptor and having at least a charging step, an exposing step, a developing step, and a transferring step, wherein the electrophotographic photoreceptor has a photosensitive layer, the photosensitive layer contains a compound having a structure represented by the above Formula (1) as a charge transport material, and the toner for developing an electrostatic charge image contains at least titanic acid compound particles as an external additive. This feature is a technical feature common to the following embodiments.

As an embodiment of the present invention, from the viewpoint that the effect of the present invention may be more highly expressed, it is preferable that the above-mentioned titanic acid compound particles contain lanthanum. The titanic acid compound particles contain lanthanum, thereby reducing the resistance. Thus, the charging amount of the toner may be adjusted to be lower, and the adhesion of the toner to the photoreceptor may be reduced. The titanic acid compound particles have a rectangular parallelepiped shape due to the perovskite crystal structure, but the crystal structure may be changed by containing lanthanum to approximate the particle shape to a spherical shape. As a result, scratches do not easily occur on the surface of the photoreceptor, and wear resistance of the photoreceptor may be secured.

As an embodiment of the present invention, from the viewpoint that the effect of the present invention may be more highly expressed, it is preferable that X of the above Formula (1) is a group having a structure represented by the following Formula (2), and Y is a hydrogen atom, an alkyl group having 1 to 7 carbon atoms, an alkoxy group having 1 to 7 carbon atoms, or a group having a structure represented by the following Formula (3) or Formula (4), Formula (2)

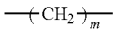

(In Formula (2), m represents an integer of 0 to 5.)

Formula (3)

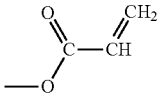

Formula (4)

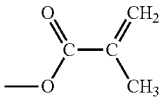

The group having the structure shown by Formula (3) is an acryloyloxy group, and the group having the structure shown by Formula (4) is a methacryloyloxy group, and these are a radically polymerizable group. In the photosensitive layer according to the present invention, when the raw material of the binder resin forming this is a compound having a radically polymerizable group, these may be reacted. As described above, in the charge transport material (1), it is possible to appropriately adjust the terminal group according to the type of the binder resin.

As an embodiment of the present invention, from the viewpoint of possible to realize a higher effect of the present invention, the titanic acid compound particles are preferably any of strontium titanate particles, calcium titanate particles, magnesium titanate particles, or barium titanate particles. These titanic acid compound particles are preferable in terms of easy control of particle size and ease of manufacture. Further, it is preferable that the number average primary particle diameter of the titanic acid compound particles is in the range of 10 to 100 nm.

As an embodiment of the present invention, from the viewpoint that the effect of the present invention may be more highly expressed, it is preferable that the content ratio of the titanic acid compound particles described above is in the range of 0.1 to 1.0% by mass based on the total amount of the toner for developing an electrostatic charge image described above.

As an embodiment of the present invention, from the viewpoint that the effect of the present invention may be more highly expressed, it is preferable that the photosensitive layer described above comprises a plurality of layers and contains a charge transport material (1) in the outermost surface layer of the photosensitive layer described above. In addition, in that case, it is preferable that the outermost layer is a layer obtained by curing a composition containing a polymerizable compound and a charge transport material (1). Further, it is preferable that the outermost layer contains at least 1 kind selected from silica fine particles, tin oxide fine particles, titania fine particles and alumina fine particles from the viewpoint that the effect of the present invention may be exhibited higher.

The image forming system of the present invention is an image forming system using a toner for developing an electrostatic charge image and an electrophotographic photoreceptor and having at least a charging step, an exposing step, a developing step and a transferring step, and it is characterized in that the image forming method of the present invention is carried out.

Hereinafter, the present invention and the constitution elements thereof, as well as configurations and embodiments to carry out the present invention, will be detailed in the following. In the present description, when two figures are used to indicate a range of value before and after "to", these figures are included in the range as a lowest limit value and an upper limit value.

[Image Forming Method]

The image forming method of the present invention is an image forming method using a toner for developing an electrostatic charge image and an electrophotographic photoreceptor and having at least a charging step, an exposing step, a developing step, and a transferring step, wherein the electrophotographic photoreceptor has a photosensitive layer, the photosensitive layer contains a compound having a structure represented by the above Formula (1) as a charge transport material, and the toner for developing an electrostatic charge image contains at least titanic acid compound particles as an external additive.

The image forming method of the present invention includes at least a charging step of charging the photoreceptor, an exposing step of exposing the photoreceptor to form an electrostatic charge image, a developing step of developing the electrostatic charge image with the toner, and a transferring step of transferring the developed toner image. The image forming method generally further includes a fixing step of fixing the toner image transferred to the transfer material, and a cleaning step of cleaning the photoreceptor after the transfer step. Hereinafter, each step will be described.

<Charging Step>

The charging step is a step of charging the photoreceptor by applying a uniform potential to the photoreceptor. The method of charging the photoreceptor is not particularly limited, and may be a known method such as, for example, a charging roller method in which the photoreceptor is charged by a contact or non-contact charging roller.

<Exposing Step>

The exposing step is a step of performing exposure based on an image signal on the photoreceptor to which a uniform potential is given by the charging step, and forming an electrostatic charge image corresponding to the image. As the exposure means, an LED in which light emitting elements are arranged in an array in the axial direction of the photosensitive element and an imaging element, or a laser optical system is used.

<Developing Step>

The developing step is a step of developing the electrostatic charge image with a dry developer containing the toner according to the present invention to form a toner image. The formation of the toner image is performed using a dry developer containing the toner, for example, using a developing means including an agitator for frictionally stir and charging the toner, and a rotatable magnet roller. More specifically, in the developing means, for example, the toner and the carrier are mixed and agitated, and the toner is charged by friction at that time and held on the surface of the rotating magnet roller, thereby forming a magnetic brush. Since the magnet roller is disposed near the photosensitive element, a part of the toner constituting the magnetic brush formed on the surface of the magnet roller moves to the surface of the photoreceptor by the electric attraction force. As a result, the electrostatic charge image is developed by the toner to form a toner image on the surface of the photoreceptor.

<Transferring Step>

In the transferring step, the toner image is transferred to a transfer material. The transfer of the toner image to the transfer material is performed by releasing and charging the toner image to the transfer material. As the transfer means, for example, a corona transfer device by corona discharge, a transfer belt, or a transfer roller may be used. The transferring step may be performed by, for example, a mode in which a toner image is primarily transferred onto an intermediate transfer member using an intermediate transfer member and then the toner image is secondarily transferred onto a transfer material, or a mode in which a toner image formed on a photoreceptor is directly transferred onto a transfer material. The transfer material is not particularly limited, and examples thereof include plain paper from thin paper to cardboard, a coated printing paper such as a high quality paper, an art paper or a coated paper, a commercially available Japanese paper or a postcard paper, a plastic film for OHP, and a cloth.

<Fixing Step>

The fixing step is a step of fixing the transfer material to which the toner image has been transferred by, for example, nip conveyance to a fixing nip portion provided between a heated fixing rotating body and a pressure member to thermally fix the transfer material.

<Cleaning Step>

After the transfer process, there are toners on the photoreceptor that have not been used for image formation or have remained untransferred. In the cleaning step, for example, the toner is removed by a blade which is provided so that its tip abuts on the photoreceptor and which scrapes the surface of the photoreceptor.

In the present invention, as the photoreceptor and the toner used in such an image forming method, the photoreceptor and the toner having the above technical features are used in combination. Hereinafter, the photoreceptor and the toner will be described in detail.

[Photoreceptor]

The photoreceptor used in the present invention has a photosensitive layer, and the photosensitive layer contains a charge transport material (1). In the photoreceptor, the photosensitive layer is formed, for example, on a conductive support. The photoreceptor according to the present invention may further have an intermediate layer between the conductive support and the photosensitive layer, if necessary.

The photosensitive layer has the following layer configurations (A) to (D), for example as a configuration in which the layers are stacked in this order from the conductive support side.

(A) A monolayer containing a charge generating material and a charge transport material (B) Two layers including a layer containing a charge generating material and a charge transport material, and a surface protective layer formed on the layer (C) Two layers including a charge generating layer containing a charge generating material and a charge transport layer containing a charge transport material (D) Three layers including a charge generating layer containing a charge generating material, a charge transport layer containing a charge transport material, and a surface protective layer In the layer configurations of (A) to (D) above, the charge transport material (1) may be contained in the layer containing the charge transport material and the surface protective layer. The charge transport material (1) is preferably contained in the outermost layer of the photosensitive layer. In the case of (B) and (D), the outermost layer is a surface protective layer, and in the case of (C), the outermost layer is a charge transport layer. As a configuration of the photosensitive layer, among these, the configuration of (C) or (D) described above is preferred, and the configuration of (D) is particularly preferred.

Figure 2:
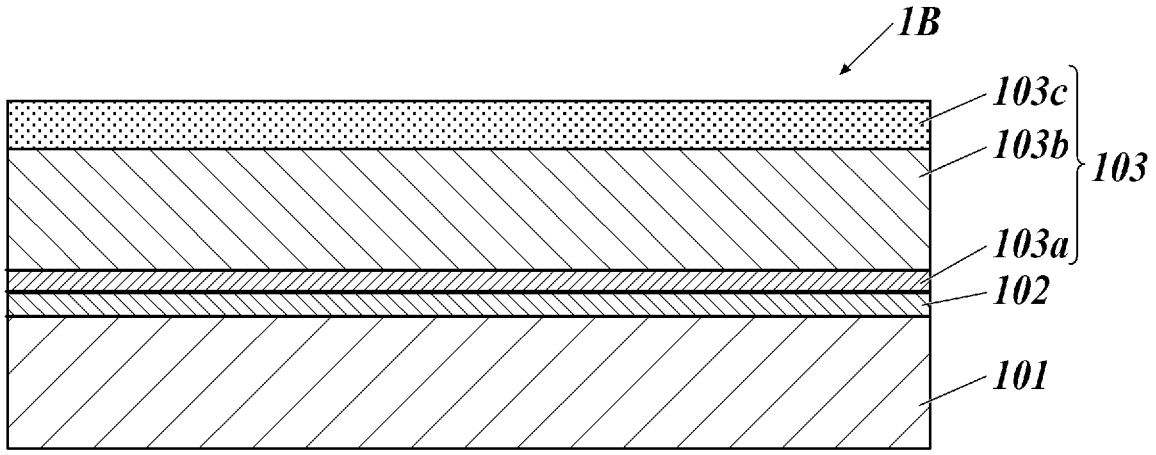
FIG. 2 is a cross-sectional view showing another example of a layer configuration of an electrophotographic photoreceptor according to the present invention.

As the photoreceptor used in the present invention, for example, a photoreceptor having a layer configuration in which a cross-sectional view is shown in FIG. 1 or FIG. 2 is preferred. The photoreceptor 1A shown in FIG. 1 has an intermediate layer 102 on a conductive support 101, and has a photosensitive layer 103 having a configuration of a charge generating layer 103*a* and a charge transport layer 103*b* thereon. The photoreceptor 1B shown in FIG. 2 has an intermediate layer 102 on a conductive support 101, and has a photosensitive layer 103 having a configuration of a charge generating layer 103*a*, a charge transport layer 103*b*, and a surface protective layer 103*c* thereon.

Hereinafter, regarding the photoreceptor according to the present invention, the photoreceptor 1A shown in FIG. 1 having the constitution of the photosensitive layer having the configuration of the above (C) and the photoreceptor 1B shown in FIG. 2 having the configuration of the photosensitive layer having the configuration of the above (D) will be described as an example. The photoreceptor 1A and the photoreceptor 1B may have the same configuration of the conductive support 101, the intermediate layer 102, and the charge generating layer 103*a*.

In the photoreceptor 1A, the charge transport material (1) is contained in the charge transport layer 103*b*. In the photoreceptor 1B, the charge transport material (1) is contained in the charge transport layer 103*b* or the surface protective layer 103*c*. Both the charge transport layer 103*b* and the surface protective layer 103*c* may contain a charge transport material (1).

(Charge Transport Material (1))

In the present invention, the charge transport material (1) contained in the photosensitive layer is a compound having a structure represented by the following Formula (1).

Formula (1)

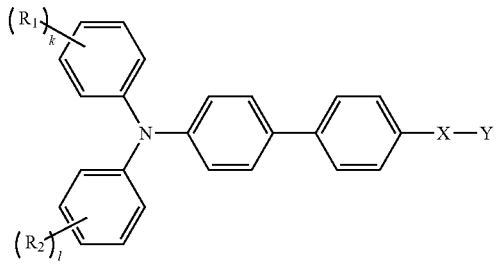

In Formula (1), $R_1$ and $R_2$ each independently represent an alkyl group having 1 to 7 carbon atoms or an alkoxy group having 1 to 7 carbon atoms; k and l each independently represent an integer of 0 to 5; $R_1$ may be the same or different when k is 2 or more, and $R_2$ may be the same or different when l is 2 or more. X represents a single bond or an alkylene chain. Y represents a hydrogen atom, an alkyl group having 1 to 7 carbon atoms, an alkoxy group having 1 to 7 carbon atoms or a substituent having a reactive group.

The charge transport material (1) is a compound having a skeleton in which a benzene ring is bonded to 1 of phenyl groups of triphenylamine, and is a compound having permeability to light rays while sufficiently exhibiting memory characteristics in which the spread of the conjugated system is appropriately adjusted by the structure.

The charge transport material (1) specifically denotes a compound in which Ph-$(R_1)_k$, Ph-$(R_2)_l$ and Ph-Ph-X-Y (where Ph denotes a phenyl group or a phenylene group) are bonded to a nitrogen atom.

In Formula (1), the Ph-$(R_1)_k$ attached to the nitrogen atom denotes a group of Ph-, which may be substituted with k pieces of $R_1$. k represents an integer of 0 to 5, preferably 0 to 2. When k is greater than or equal to 2, $R_1$ may be the same or different. When k is 2 or more, $R_1$ is preferably the same from the viewpoint of ease of production.

$R_1$ is an alkyl group having 1 to 7 carbon atoms or an alkoxy group having 1 to 7 carbon atoms. The alkyl group and the alkyl group possessed by the alkoxy group may be linear, branched, cyclic or a combination thereof. The number of carbon atoms of the alkyl group and the alkoxy group is preferably 1 to 3, more preferably 1 or 2, and particularly preferably 1. The binding position of $R_1$ in the Ph-$(R_1)_k$ is preferably from position 3 to 5, except for positions 2 and 6, where Ph is both sides of the position to which the phenyl group (Ph) is bound to the nitrogen atom.

In Formula (1), the Ph-$(R_2)_l$ attached to a nitrogen atom denotes a phenyl group which may be substituted with 1 pieces of $R_2$. In the Ph-$(R_2)_l$, $R_2$ may be the same as $R_1$, and l may be similar to k, including the preferred embodiment. In Formula (1), Ph-$(R_1)_k$ and Ph-$(R_2)_l$ may be the same or different.

In Formula (1), Ph of Ph-Ph-X-Y, which is bonded to a nitrogen atom, is a 1,4-phenylene group. X represents a single bond or an alkylene chain. The alkylene chain may be straight or branched, and preferably has 1 to 10 carbon atoms. X is preferably represented by Formula (2): —$(CH_2)_m$—, where m is an integer of 0 and 5.

Y represents a hydrogen atom, an alkyl group having 1 to 7 carbon atoms, an alkoxy group having 1 to 7 carbon atoms or a substituent having a reactive group. The alkyl group and the alkyl group possessed by the alkoxy group may be linear, branched, cyclic or a combination thereof. When Y is a hydrogen atom, an alkyl group having 1 to 7 carbon atoms or an alkoxy group having 1 to 7 carbon atoms, it is preferable that —X-Y is a hydrogen atom, a linear alkyl group having 1 to 5 carbon atoms or a linear alkoxy group having 1 to 5 carbon atoms.

When Y is a substituent with a reactive group, examples of the reactive group include an amino group, an epoxy group, a carboxy group, a hydroxy group, a mercapto group, an isocyanate group, and a vinyl group. As the reactive group, a vinyl group is preferred, and as the substituent having a vinyl group as a reactive group, an acryloyloxy group having a structure shown by the following Formula (3) and a methacryloyloxy group having a structure shown by the following Formula (4) are preferred.

Formula (3)

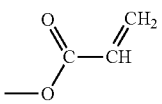

Formula (4)

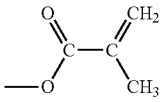

In the charge transport material (1), examples of the compound in which Y of the general formula (1) is an acryloyloxy group or a methacryloyloxy group include compounds having a structure shown by the following Formula CTM-1 to CTM-21, respectively. In the charge transport material (1), examples of the compound in which —X-Y of the Formula (1) is a hydrogen atom, a linear alkyl group having 1 to 5 carbon atoms or a linear alkoxy group having 1 to 5 carbon atoms include compounds having a structure shown by the following Formula CTM-30 to CTM-46, respectively. Hereinafter, a compound having a structure shown by Formula CTM-1 is also referred to as a compound CTM-1. The same applies to other compounds.

CTM-1

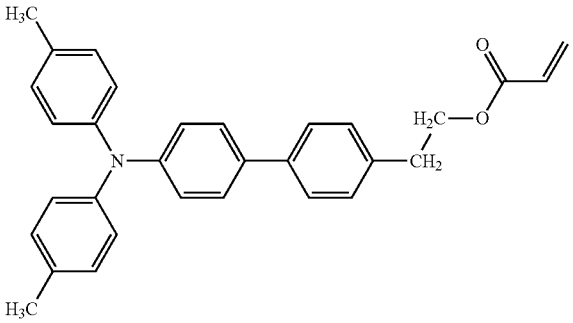

CTM-2

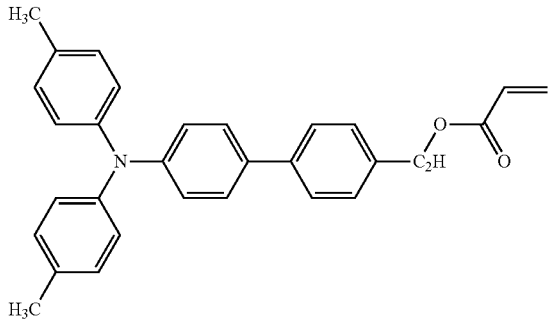

CTM-3

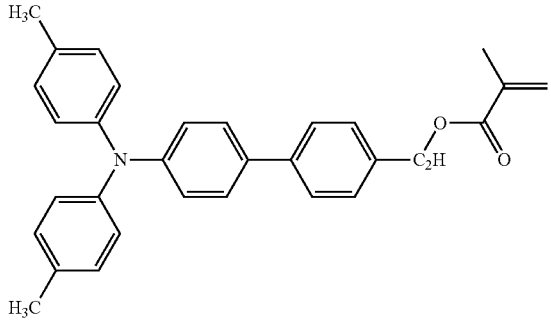

-continued
CTM-4
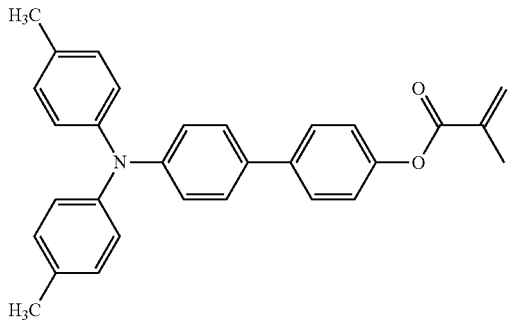
CTM-5
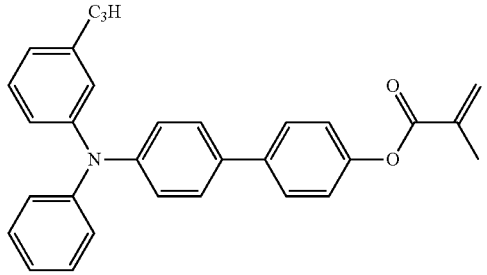
CTM-6
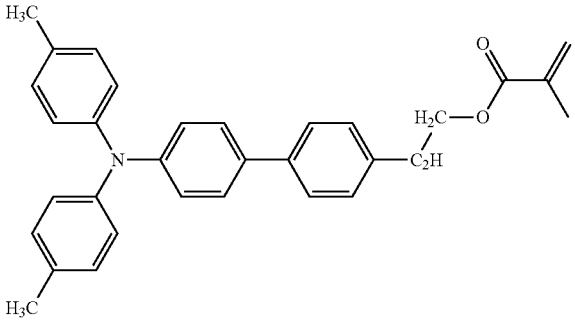
CTM-7
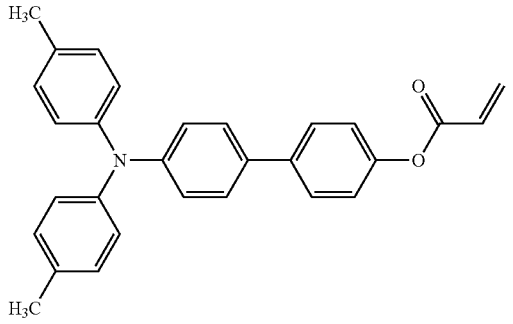
CTM-8
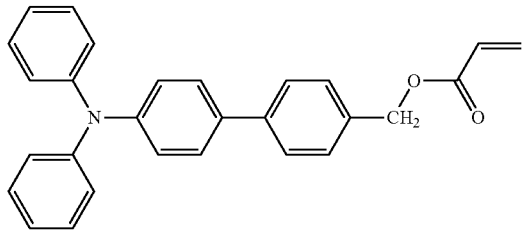
-continued
CTM-9
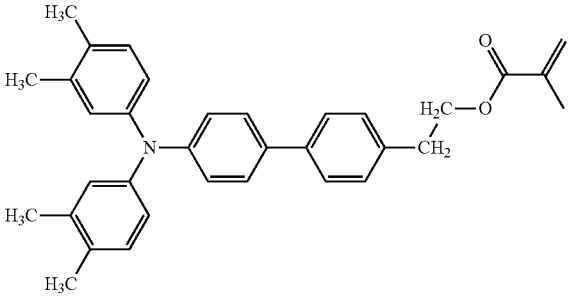
CTM-10
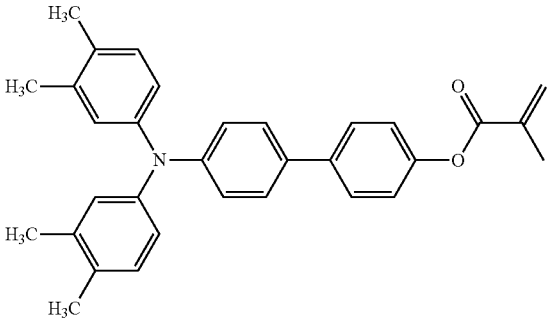
CTM-11
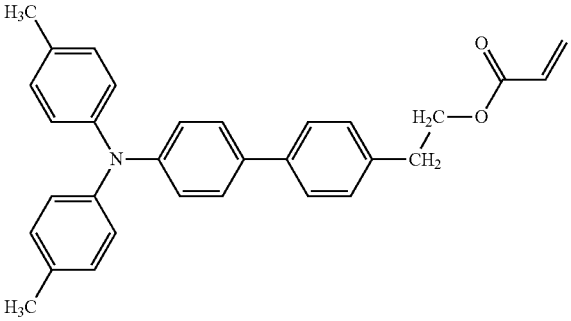
CTM-12
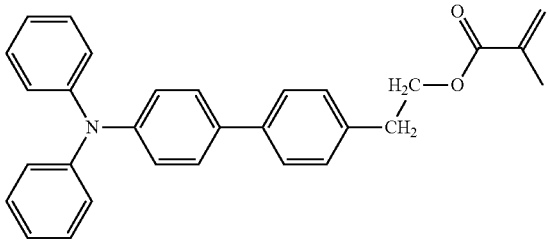
CTM-13
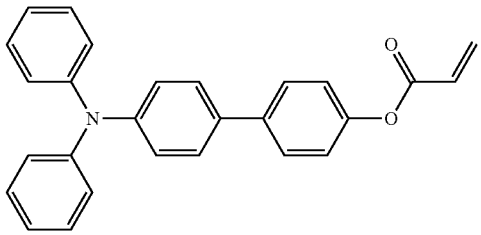

-continued
CTM-14
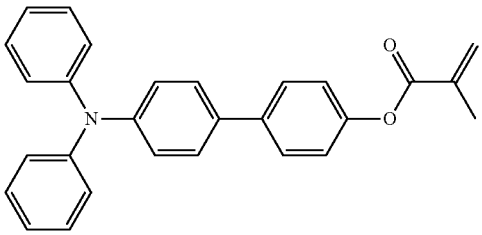
CTM-15
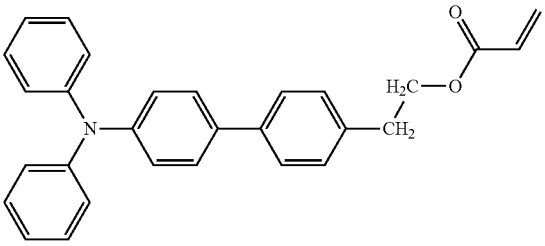
CTM-16
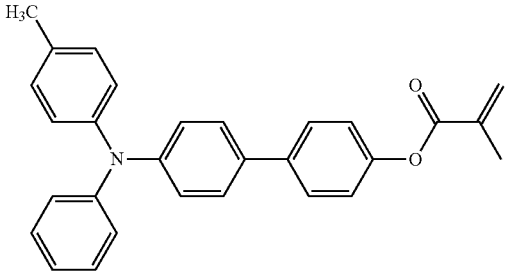
CTM-17
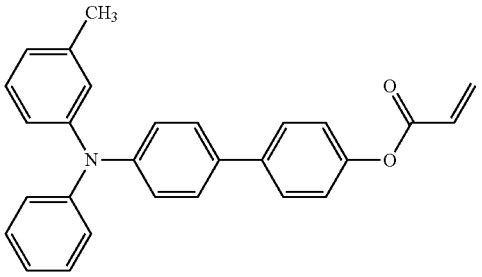
CTM-18
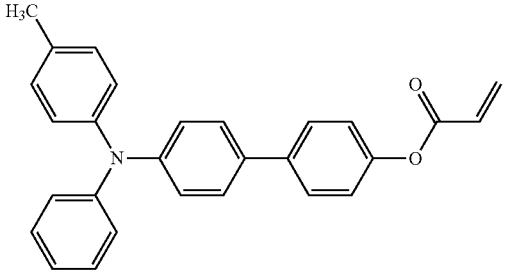
-continued
CTM-19
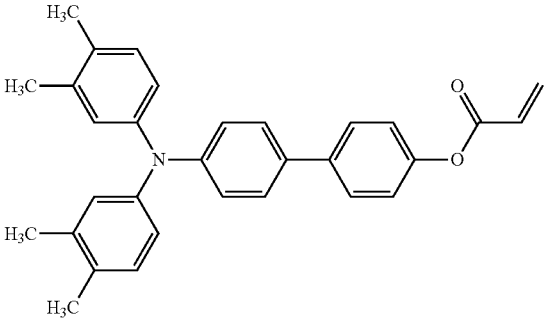
CTM-20
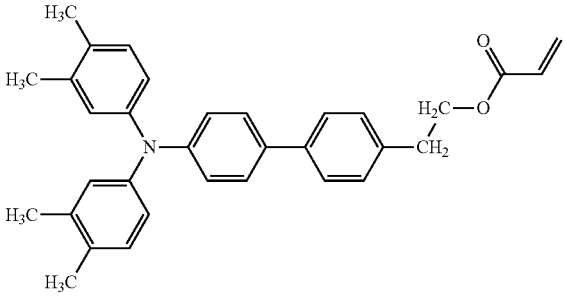
CTM-21
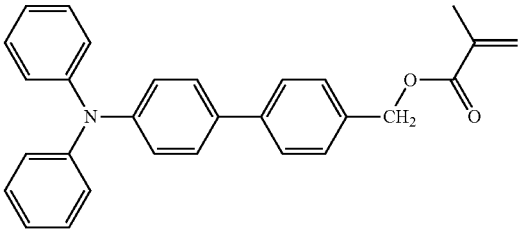
CTM-30
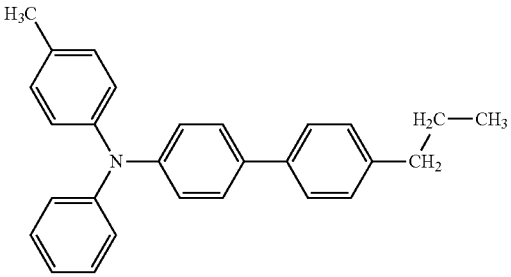
CTM-31
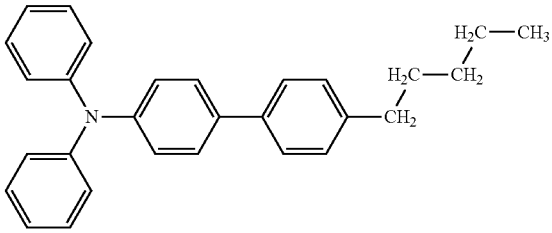

-continued
CTM-32
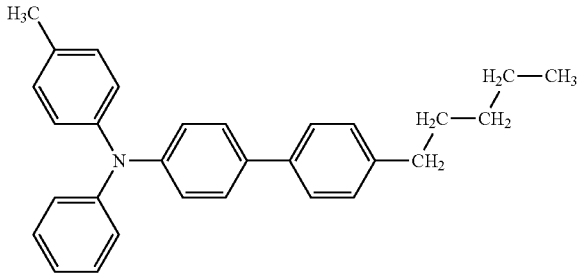
CTM-33
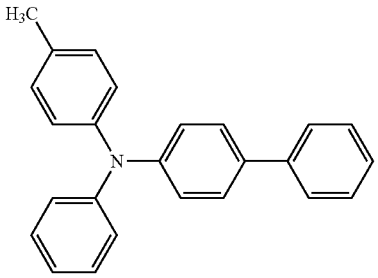
CTM-34
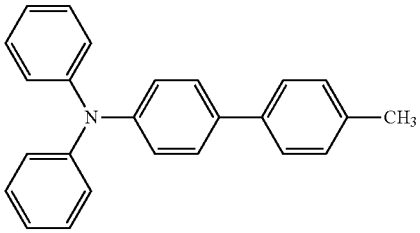
CTM-35
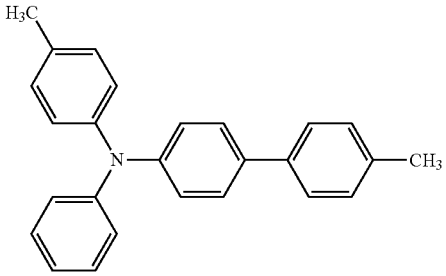
CTM-36
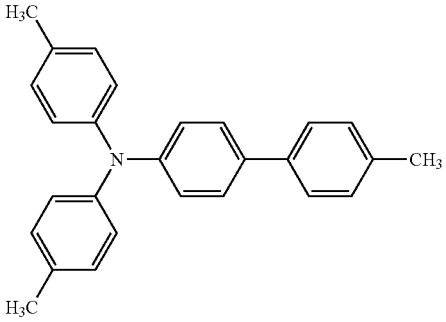
-continued
CTM-37
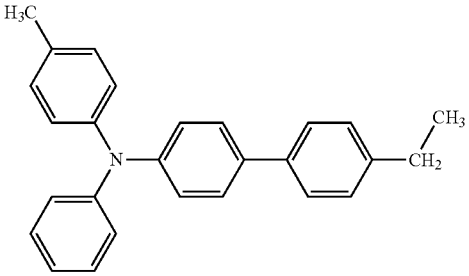
CTM-38
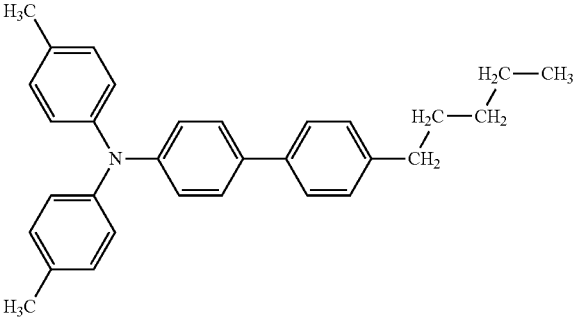
CTM-39
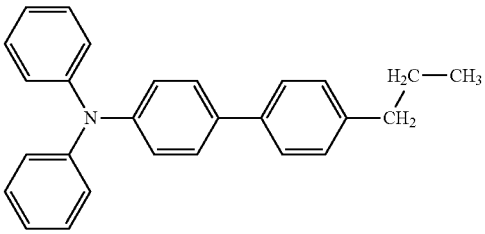
CTM-40
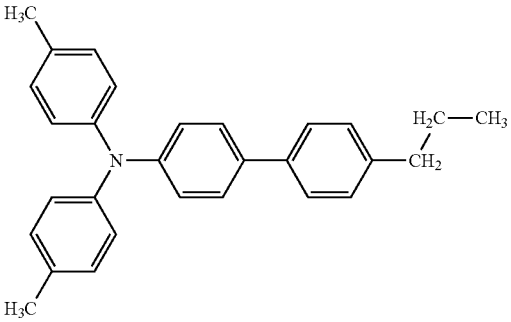
CTM-41
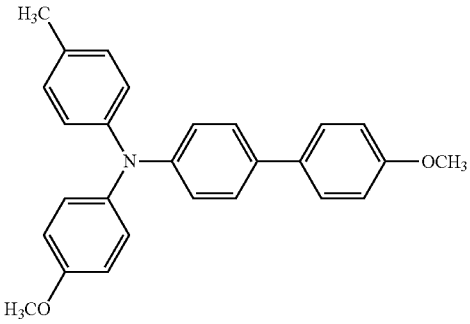

-continued
CTM-42
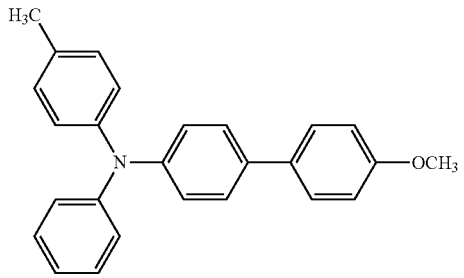
CTM-43
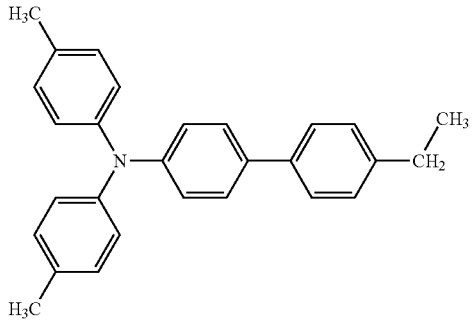
CTM-44
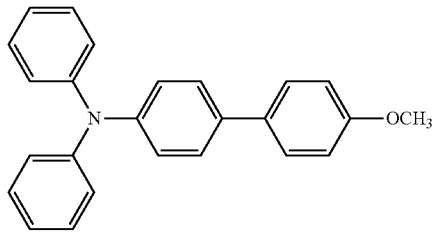
CTM-45
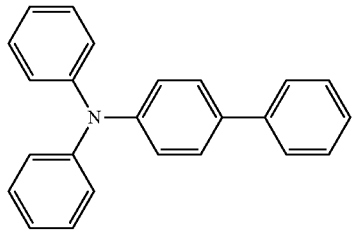
CTM-46
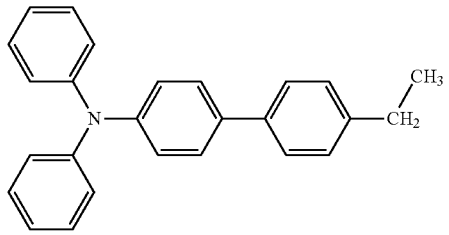
The charge transport material (1) may be produced by a known method. For example, the compound CTM-1 may be produced by the reaction route shown in the following Reaction scheme (1). Further, for example, the compound CTM-30 may be produced by the following reaction route in the following Reaction scheme (2).
Reaction scheme (1)
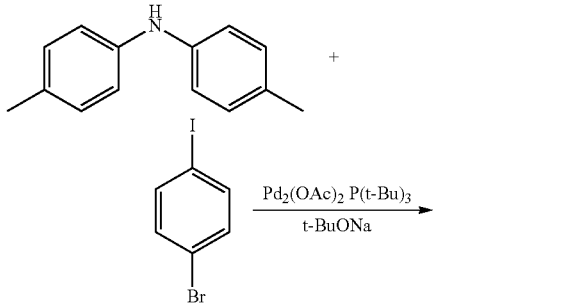
(a)
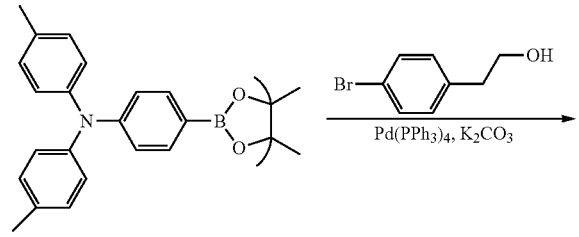
(b)
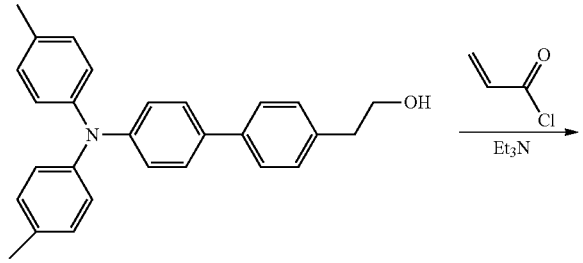
(c)
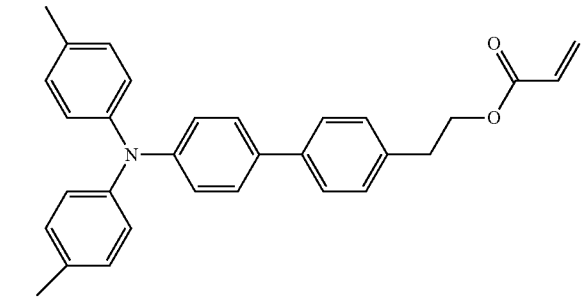
CTM-1
Reaction scheme (2)
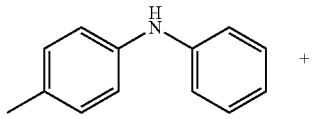

-continued

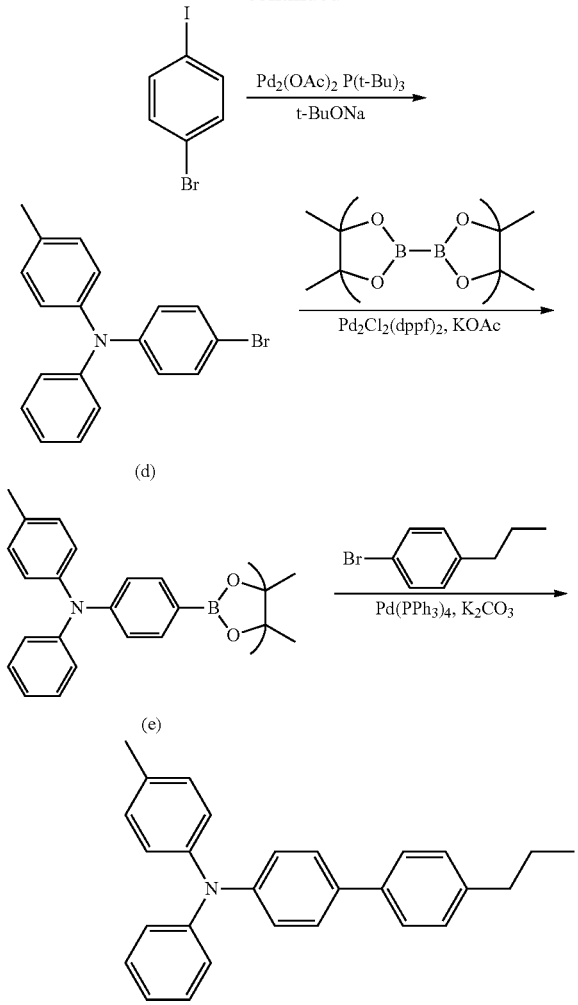

CTM-30

The layer containing the charge transport material (1) further contains a binder resin which is a layer forming component. The binder resin is preferably a resin obtained by curing a polymerizable compound. Further, when the charge transport material (1) has a reactive group, by using a polymerizable compound capable of reacting with the reactive group, the charge transport material (1) is bonded to the binder resin to form a layer in which bleed-out is suppressed.

In the photoreceptor 1A, the charge transport material (1) is contained in the charge transport layer 103*b*. In the photoreceptor 1B, the charge transport material (1) is preferably contained in the surface protective layer 103*c*, and more preferably is contained in both the surface protective layer 103*c* and the charge transport layer 103*b*. First, a surface protective layer 103*c* of the photosensitive 1B will be described below.

[Surface Protective Layer]

When the charge transport layer 103*b* contains the charge transport material (1), the surface protective layer 103*c* may not contain the charge transport material (1). But it is preferable that the surface protective layer 103*c* contains the charge transport material (1) regardless of whether the charge transport material (1) is contained in the charge transport layer 103*b* or not.

When the surface protective layer 103*c* contains a charge transport material (1), the surface protective layer 103*c* contains a charge transport material (1) and a binder resin. The charge transport material (1) is as described above. The surface protective layer 103*c* may contain other charge transport materials other than the charge transport material (1) as a charge transport material within a range not impairing the effect of the present invention. The surface protective layer 103*c* may further contain metal oxide fine particles.

Examples of the other charge transport materials include a triphenylamine derivative, a hydrazone compound, a styryl compound, a benzidine compound, and a butadiene compound other than the charge transport material (1). The content of the other charge transport material in the charge transport material is preferably 5% by mass or less, more preferably 3% by mass or less, and particularly preferably not contained.

In the surface protective layer 103*c*, the content of the charge transport material is preferably from 20 to 80 parts by mass, more preferably from 30 to 70 parts by mass, and still more preferably from 40 to 60 parts by mass, per 100 parts by mass of the binder resin from the viewpoint of achieving both memory performance and cleaning performance.

In the surface protective layer 103*c*, a conventional thermoplastic resin, a thermosetting resin, and a photocurable resin may be used as the binder resin. Specific examples of the binder resin include a polystyrene resin, a polyethylene resin, a polypropylene resin, an acrylic resin, a methacrylic resin, an epoxy resin, a polyurethane resin, a polyester resin, an alkyd resin, a polycarbonate resin, a polyarylate resin, a polysulfone resin, and a polyamide resin.

The binder resin contained in the surface protective layer 103*c* is preferably a cured product of a polymerizable compound. Examples of the cured product of a polymerizable compound include a polystyrene resin, an acrylic resin, a methacrylic resin, an epoxy resin, and a polyurethane resin. The surface protective layer 103*c* is preferably a layer obtained by curing a composition containing a polymerizable compound and a charge transport material (1).

As the above polymerizable compound, a monomer which is polymerized (cured) by irradiation with active rays such as ultraviolet rays or electron beams and becomes a resin generally used as a binder resin of a photoreceptor, such as a polystyrene resin, an acrylic resin, or a methacrylic resin, is suitable. Particularly preferred are a styrenic monomer, an acrylic monomer, a methacrylic monomer, a vinyltoluene monomer, a vinyl acetate monomer, and an N-vinylpyrrolidone monomer.

Among these, radically polymerizable monomers having an acryloyl group ($CH_2$=CHCO—) or a methacryloyl group ($CH_2$=$CCH_3$CO—) or oligomers thereof are particularly preferable because they may be cured with a small amount of light or in a short period of time.

As the radically polymerizable monomer, a polyfunctional radically polymerizable monomer having 3 or more radically polymerizable groups is preferred from the viewpoint of forming a protective layer having high hardness with high crosslinking density. Specific examples of the polyfunctional radically polymerizable monomer having 3 or more acryloyl groups or methacryloyl groups include a compound having a structure represented by the following formulas M1 to M11. In the following compounds, R represents an acryloyl group, and R' represents a methacryloyl group.

M1

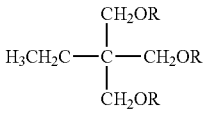

M2

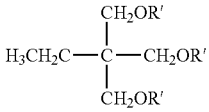

M3

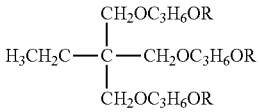

M4

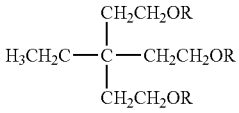

M5

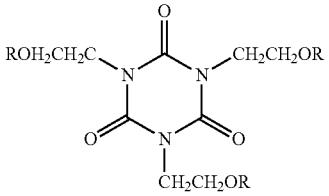

M6

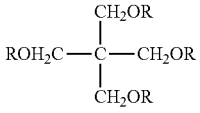

M7

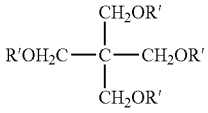

M8

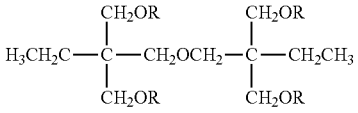

M9

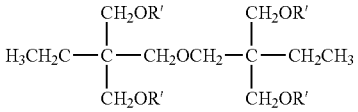

M10

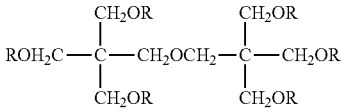

M11

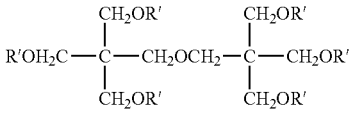

These radically polymerizable monomers are known and may also be obtained as commercially available products. As the radically polymerizable monomer, 1 of these may be used alone, or 2 or more of them may be used in combination.

Further, as a radically polymerizable monomer for obtaining a binder resin, a 2 functional radically polymerizable monomer and a monofunctional radically polymerizable monomer may be used in combination in addition to a polyfunctional radically polymerizable monomer having 3 or more of the above functional groups.

Polymerization (curing) of the above radically polymerizable monomer is performed using a photopolymerization initiator. As the photopolymerization initiator, an alkylphenone-based compound or a phosphine oxide-based compound is preferred. In particular, a compound having an α-hydroxyacetophenone structure or an acylphosphine oxide structure is preferred.

Examples of the compound having an acylphosphine oxide structure include 2,4,6-trimethylbenzoyl-diphenylphosphine oxide and bis(2,4,6-trimethylbenzoyl)phenylphosphine oxide. These may be used commercially available products, and Irgacure™ TPO (product name, manufactured by BASF Co., Ltd.) may be used as the 2,4,6-trimethylbenzoyl-diphenylphosphine oxide, and Irgacure™ 819 (product name, manufactured by BASF Co., Ltd.) may be used as bis(2,4,6-trimethylbenzoyl)phenylphosphine oxide.

The photopolymerization initiator is preferably used in a ratio of 3 to 15 parts by mass, more preferably 5 to 10 parts by mass, per 100 parts by mass of the radically polymerizable monomer. When a cured product of a polymerizable compound is used as the binder resin, the amount thereof is defined as the total amount of the polymerizable compound and the polymerization initiator.

The surface protective layer 103*c* may further contain metal oxide fine particles. Metal oxide fine particles according to the present invention is preferably metal oxide fine particles also including a transition metal. Examples of the metal oxide constituting the metal oxide fine particles include silica (silicon dioxide), magnesium oxide, zinc Oxide, lead oxide, alumina (aluminum oxide), tantalum oxide, indium oxide, bismuth oxide, yttrium oxide, cobalt oxide, copper oxide, manganese oxide, selenium oxide, iron oxide, zirconium oxide, germanium oxide, tin oxide, titania (titanium oxide), niobium oxide, molybdenum oxide, and vanadium oxide.

As the metal oxide fine particles, among them, at least one selected from silica fine particles, tin oxide fine particles, titania fine particles and alumina fine particles is preferred because the abrasion resistance of the surface protective layer may be improved. One kind of these may be used alone, or 2 or more kinds thereof may be used in combination.

The metal oxide fine particles are preferably produced by a known method, for example, a general production method such as a gas phase method, a chlorine method, a sulfuric acid method, a plasma method, or an electrolysis method.

The number average primary particle diameter of the above metal oxide fine particles is preferably in the range of 1 to 300 nm. Particularly preferred is the range of 3 to 100 nm.

(Measuring Method of Particle Diameter of Metal Oxide Fine Particles)

A particle diameter of the metal oxide fine particles (number average primary particle diameter) is measures as follows. A scanning electron microscope (manufactured by JEOL Ltd.) is used to take an enlarged photograph of 10000 times of the sample. The photographic image taken by the scanner for randomly selected 300 particles (aggregated particles were removed) was subjected to an automatic image processing analyzer "Luzex AP (LUZEX (registered trademark) AP)" (Nireco Corporation) with software Ver. 1.32. The data is binarized and, the horizontal Feret diameter is calculated respectively. The average value is calculated as the number average primary titanic acid compound. Here, the horizontal Feret diameter refers to the length of the side parallel to the X-axis of the circumscribed rectangle when the image of the metal oxide fine particles is binarized.

When needed, the metal oxide fine particles may be subjected to treatment such as hydrophobization of the surface by a known surface modifier. The surface modifier used may be 1 or 2 or more kinds. Examples of the surface modifier include a silane coupling agent, a silicone oil, a titanate-based coupling agent, an aluminate-based coupling agent, a fatty acid, a fatty acid metal salt, an ester product thereof, and Rosin acid.

Examples of the above silane coupling agent include dimethyldimethoxysilane, hexamethyldisilazane (HMDS), methyltrimethoxysilane, isobutyltrimethoxysilane and decyltrimethoxysilane. Examples of the above silicone oil include cyclic, linear and branched organosiloxanes. More specific examples of the surface modifyer include organosiloxane oligomers, octamethylcyclotetrasiloxane, decamethylcyclopentasiloxane, tetramethylcyclotetrasiloxane, and tetravinyltetramethylcyclotetrasiloxane.

The amount of the surface modifier used for the hydrophobization treatment of the surface is preferably an amount in which the carbon content ratio in the metal oxide fine particles after the hydrophobization treatment is in the range of 0.1 to 10% by mass.

The content of the metal oxide fine particles in the surface protective layer 103*c* is preferably in the range of 5 to 40 parts by mass, more preferably in the range of 10 to 30 parts by mass, per 100 parts by mass of the binder resin from the viewpoint of imparting durability such as abrasion resistance to the surface protective layer 103*c* without impairing the effect of the present invention.

In addition to the charge transport material containing the charge transport material (1) described above, the binder resin, and the metal oxide fine particles which are optional components, the surface protective layer 103*c* according to the present invention may contain other component. Examples of the other component include an antioxidant, a stabilizer, and a silicone oil. As for the antioxidant, those disclosed in JP 2000-305291 are preferred.

The thickness of the surface protective layer 103*c* is preferably 0.2 to 10 μm, more preferably 0.5 to 6 μm.

[Charge Transport Layer]

The charge transport layer 103*b* contains a charge transport material and a binder resin (hereinafter also referred to as "binder resin for charge transport layer").

The charge transport layer 103*b* in the photoreceptor 1A contains a charge transport material (1) as a charge transport material. On the other hand, in the photoreceptor 1B, when the surface protective layer 103*c* contains the charge transport material (1), the charge transport material contained in the charge transport layer 103*b* is not particularly limited. In other words, the charge transport material may or may not contain a charge transport material (1). In the photoreceptor 1B, when the surface protective layer 103*c* does not contain the charge transport material (1), the charge transport material contained in the charge transport layer 103*b* contains the charge transport material (1). In either case, it is preferable that the charge transport layer 103*b* contains a charge transport material (1) as a charge transport material in the photoreceptor 1B.

The charge transport layer 103*b* in the photoreceptor 1A and the charge transport layer 103*b* in the photoreceptor 1B may have the same structure. Unless otherwise specified, the configuration is common to the charge transport layer 103*b* in the photoreceptor 1A and the charge transport layer 103*b* in the photoreceptor 1B.

The charge transport material (1) and other charge transport materials other than the charge transport material (1) are as described above. The ratio of the charge transport material (1) and other charge transport material other than the charge transport material (1) in the charge transport material contained in the charge transport layer may be the same as in the case of the surface protective layer.

As the binder resin for the charge transport layer, a known resin may be used, and a polycarbonate resin, a polyacrylate resin, a polyester resin, a polystyrene resin, a styrene-acrylonitrile copolymer resin, a polymethacrylate ester resin, or a styrene-methacrylate copolymer resin may be used. But a polycarbonate resin is preferable. Further, BPA (bisphenol A) type, BPZ (bisphenol Z) type, dimethyl BPA type, and BPA-dimethyl BPA copolymer type polycarbonate resin are preferable in terms of crack resistance, abrasion resistance and charging characteristics.

Since the charge transport layer 103*b* in the photoreceptor 1A becomes the outermost layer of the photosensitive layer 103, it is preferable that the binder resin is a cured product of a polymerizable compound similar to that of the surface protective layer.

The content of the charge transport material in the charge transport layer is preferably 10 to 500 parts by mass, more preferably 20 to 250 parts by mass, based on 100 parts by mass of the binder resin for the charge transport layer.

The thickness of the charge transport layer varies depending on the characteristics of the charge transport material, the characteristics of the binder resin for the charge transport layer, and the content ratio, but it is preferably 5 to 40 μm, more preferably 10 to 30 μm.

In the charge transport layer, an antioxidant, an electronic conductive agent, a stabilizer, or a silicone oil may be added. The antioxidant disclosed in JP-A 2000-305291 and the electronic conductive agent disclosed in JP-A 50-137543 and JP-A 58-76483 are preferable.

[Conductive Support]

The conductive support 101 included in the photoreceptor 1A and the photoreceptor 1B may be any support having conductivity. Examples of the conductive support 101 include a drum or sheet of metal such as aluminum, copper, chromium, nickel, zinc, and stainless steel. In addition, other examples are a metal foil made of metal such as aluminum or copper laminated on a plastic film; aluminum, indium oxide, or tin oxide deposited on a plastic film; and a metal, a plastic film and paper provided with a conductive layer by applying a conductive substance alone or together with a binder resin.

[Intermediate Layer]

The intermediate layer 102 that is provided in the photoreceptor 1A and the photoreceptor 1B between the conductive support 101 and the photosensitive layer 103 has a function of enhancing barrier properties or adhesiveness between the conductive support 101 and the photosensitive layer 103. Although the intermediate layer is not an essential configuration in the photoreceptor according to the present invention, it is preferable to provide an intermediate layer in consideration of various failure prevention.

Such an intermediate layer contains, for example, a binder resin (hereinafter also referred to as "binder resin for an intermediate layer") and, if necessary, conductive particles and fine metal oxide particles.

Examples of the binder resin for the intermediate layer include casein, polyvinyl alcohol, nitrocellulose, ethylene-acrylic acid copolymer, polyamide resin, polyurethane resin, and gelatin. Of these, alcohol-soluble polyamide resins are preferred.

The intermediate layer may contain various conductive fine particles or metal oxide fine particles for the purpose of resistance adjustment. As the metal oxide fine particles, for example, various metal oxide fine particles such as alumina, zinc oxide, titania, tin oxide, antimony oxide, indium oxide, bismuth oxide, and zirconium oxide may be used. Fine particles of composite metal oxides may be used such as indium oxide doped with tin and tin oxide doped with antimony.

The number average primary particle diameter of such metal oxide fine particles is preferably 10 to 300 nm, more preferably 20 to 100 nm.

One kind of conductive fine particles or metal oxide fine particles may be used alone, or 2 or more kinds thereof may be used in combination. When 2 or more of them are mixed, they may be in the form of a solid solution or a fusion.

The content ratio of the conductive fine particles or the metal oxide fine particles is preferably 20 to 400 parts by mass, more preferably 50 to 350 parts by mass, per 100 parts by mass of the binder resin.

The thickness of the intermediate layer is preferably 0.1 to 15 μm, more preferably 0.3 to 10 μm.

[Charge Generating Layer]

The charge generating layer 103*a* in the photosensitive layer 103 included in the photoreceptor 1A and the photoreceptor 1B contains a charge generating material and a binder resin (hereinafter also referred to as "binder resin for charge generating layer").

Examples of the charge generating material include azo pigments such as Sudan Red and Diane Blue, quinone pigments such as pyrenequinone and antoanthron, quinocianin pigments, perylene pigments, indigo pigments such as indigo and thioindigo, polycyclic quinone pigments such as pyranthron and diphthaloylpyrene, and phthalocyanine pigments. But examples are not limited thereto. Of these, polycyclic quinone pigments and titanyl phthalocyanine pigments are preferred. These charge generating materials may be used alone, or in combination of two or more kinds.

As the binder resin for the charge generating layer, a known resin may be used. Examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a polyester resin, an alkyd resin, a polycarbonate resin, a silicone resin, a melamine resin, and a copolymer resin containing two or more of these resins (e.g., a vinyl chloride-vinyl acetate copolymer resin, a vinyl chloride-vinyl acetate-maleic acid copolymer resin), and a poly-vinylcarbazole resin. Examples are not limited thereto. Of these, a polyvinyl butyral resin is preferred.

The content ratio of the charge generating material in the charge generating layer is preferably 1 to 600 parts by mass, more preferably 50 to 500 parts by mass, per 100 parts by mass of the binder resin for the charge generating layer.

The thickness of the charge generating layer varies depending on the characteristics of the charge generating material, the characteristics of the binder resin for the charge generating layer, but the content ratio is preferably 0.01 to 5 μm, more preferably 0.05 to 3 μm.

[Production of Photoreceptor]

The photoreceptor according to the present invention may be manufactured, for example, by sequentially forming each layer constituting a photoreceptor on a conductive support. Formation of each layer is performed by a step of forming a coating film comprising a coating liquid containing a solid content (or a raw material component thereof) constituting each layer and a solvent, and a step of curing the coating film. A specific method of manufacturing a photoreceptor according to the present invention will be described below with reference to a method of manufacturing a photoreceptor 1B shown in FIG. 2.

The photoreceptor 1B may be manufactured, for example, by passing through the following steps.

Step (1): A step of forming an intermediate layer 102 by coating a coating liquid for forming an intermediate layer on a surface of a conductive support 101 and drying the coating liquid.

Step (2): A step of forming a charge generating layer 103*a* by coating a coating liquid for forming a charge generating layer on a surface of the intermediate layer 102 formed on the conductive support 101 and drying the coating liquid.

Step (3): A step of forming a charge transport layer 103*b* by coating a coating liquid for forming a charge transport layer on to surface of the charge generating layer 103*a* formed on the intermediate layer 102 and drying the coating liquid.

Step (4): A step of forming a surface protective layer 103*c* by coating a coating liquid for forming a surface protective layer on the surface of the charge transport layer 103*b* formed on the charge generating layer 103*a* to form a coating film, and curing the coating film.

[Step (1): Formation of Intermediate Layer]

The intermediate layer 102 may be formed by dissolving a binder resin for an intermediate layer in a solvent to prepare a coating solution (hereinafter also referred to as "coating solution for forming an intermediate layer"), dispersing conductive fine particles or metal oxide fine particles as necessary, then, applying the coating solution to a predetermined thickness on a conductive support 101 to form a coating film, and drying the coating film.

As a means for dispersing conductive fine particles or metal oxide fine particles in the coating liquid for forming an intermediate layer, an ultrasonic disperser, a ball mill, a sand mill, or a homomixer may be used, but it is not limited thereto.

Known methods for applying the coating liquid for forming the intermediate layer include, for example, a dip coating method, a spray coating method, a spinner coating method, a bead coating method, a blade coating method, a beam coating method, a slide hopper method, and a circular slide hopper method. The circular slide hopper method is a method used for coating in which the outer peripheral surface of a cylindrical or cylindrical article is used as a coating surface. The circular slide hopper method may be used as a method of applying a coating liquid for forming an intermediate layer to the outer peripheral surface of a drum-shaped conductive support.

The method of drying the coating film may be appropriately selected according to the type of the solvent and the thickness of the coating film, but heat drying is preferable.

As the solvent used in the step of forming the intermediate layer 102, any solvent may be used as long as it satisfactorily disperses the conductive fine particles or the metal oxide fine particles and dissolves the binder resin for the intermediate layer. Specifically, alcohols having 1 to 4 carbon atoms such as methanol, ethanol, n-propyl alcohol, isopropyl alcohol, n-butanol, t-butanol, and sec-butanol are excellent in solubility and coating performance of the binder resin. Further, in order to improve storage stability and dispersibility of particles, the solvent may be used in combination with the above solvent, and examples of the auxiliary solvent capable of obtaining a preferable effect include benzyl alcohol, toluene, methylene chloride, cyclohexanone, and tetrahydrofuran.

The concentration of the binder resin for the intermediate layer in the coating liquid for forming the intermediate layer is appropriately selected according to the thickness and the production rate of the intermediate layer 102.

[Step (2): Formation of Charge Generating Layer]

The charge generating layer 103*a* may be formed by dispersing a charge generating material in a solution in which a charge generating layer binder resin is dissolved in a solvent to prepare a coating liquid (hereinafter also referred to as "coating liquid for forming a charge generating layer"), then coating the coating liquid to a predetermined thickness on the intermediate layer 102 to form a coating film, and drying the coating film.

As a means for dispersing the charge generating material in the coating liquid for forming the charge generating layer, for example, an ultrasonic disperser, a ball mill, a sand mill, or a homomixer may be used, but it is not limited thereto.

The application method of the application liquid for forming the charge generating layer includes, for example, a known method such as a dip coating method, a spray coating method, a spinner coating method, a bead coating method, a blade coating method, a beam coating method, a slide hopper method, and a circular slide hopper method.

The method of drying the coating film may be appropriately selected according to the type of the solvent and the thickness of the coating film, but heat drying is preferable.

Examples of the solvent used for forming the charge generating layer 103*a* include, but are not limited to, toluene, xylene, methylene chloride, 1,2-dichloroethane, methyl ethyl ketone, cyclohexane, ethyl acetate, t-butyl acetate, methanol, ethanol, propanol, butanol, methylcellosolve, 4-methoxy-4-methyl-2-pentanone, ethylcellosolve, tetrahydrofuran, 1-dioxane, 1,3-dioxolane, pyridine, and diethylamine.

[Step (3): Formation of Charge Transport Layer]

The charge transport layer 103*b* may be formed by preparing a coating solution in which a charge transport layer binder resin or its raw material component (polymerizable compound) and a charge transport material are dissolved in a solvent (hereinafter also referred to as a "charge transport layer forming coating solution"), then coating the coating solution to a certain thickness on the charge generating layer 103*a* to form a coating film, and drying the coating film. When the binder resin is a cured product of a polymerizable compound, the charge transport layer 103*b* is formed by curing the polymerizable compound during the coating for forming the charge transport layer by heating or irradiation with an active ray.

Note that as the charge transport material contained in the application liquid for forming the charge transport layer, when the surface protective layer 103*c* described below does not contain the charge transport material (1), it is essential to use the charge transport material (1), and when the surface protective layer 103*c* contains the charge transport material (1), it is preferable to use the charge transport material (1) which is not essential.

Application methods for charge transport layer forming application solutions include known methods such as, for example, a dip coating method, a spray coating method, a spinner coating method, a bead coating method, a blade coating method, a beam coating method, a slide hopper coating method, and a circularity slide hopper coating method.

The method of drying the coating film may be appropriately selected according to the type of the solvent and the thickness of the coating film, but heat drying is preferable.

Examples of the solvent used for forming the charge transport layer 103*b* include, but are not limited to, toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine.

When the binder resin for the charge transport layer is a cured product of a polymerizable compound, curing is performed by the same method as in the case where the binder resin of the following surface protective layer is a cured product of a polymerizable compound.

[Step (4): Formation of Surface Protective Layer]

In forming the surface protective layer 103*c*, first, a binder resin or a raw material component thereof and a charge transport material containing an optional or essential charge transport material (1) and other components other than these to be added if necessary are added to a known solvent to prepare a coating liquid (hereinafter, also referred to as "coating liquid for forming a surface protective layer"). The addition of the charge transport material (1) is essential when the charge transport layer 103*b* does not contain the charge transport material (1). When the charge transport layer 103*b* contains a charge transport material (1), the addition of the charge transport material (1) is not essential, but is preferably added.

Preparation of the coating liquid for forming the surface protective layer is performed by dissolving or dispersing each of the above components in a solvent. When the coating liquid for forming the surface protective layer contains metal oxide fine particles, the metal oxide fine particles are dispersed in a solvent and used. As a means for dispersing the metal oxide fine particles in a solvent, an ultrasonic disperser, a ball mill, a sand mill, or a homomixer may be used, but it is not limited thereto.

As a solvent used for forming the surface protective layer, any solvent may be used as long as each of the above components may be dissolved or dispersed. Examples of the solvent include, but are not limited to, methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methylcellosolve, ethylcellosolve, tetrahydrofuran, 1-dioxane, 1,3-dioxolane, pyridine and diethylamine.

Then, the obtained coating liquid for forming a surface protective layer is applied to the surface of the charge transport layer 103*b* formed by Step (3) to form a coating film.

Methods of application of application solutions for surface protective layer formation include known methods such as, for example, a dip coating method, a spray coating method, a spinner coating method, a bead coating method, a blade coating method, a beam coating method, a slide hopper coating method, and a circularity slide hopper coating method. In the case of manufacturing a drum-shaped photoreceptor, a circular slide hopper method is preferable as a method of applying the coating liquid for forming the surface protective layer to the surface to be coated.

The application by the circular slide hopper method may be performed by using a circular slide hopper application apparatus. In the circular slide hopper coating apparatus, the coating liquid is shared with the slide surface of the apparatus, and the coating liquid flows down from the end of the slide surface toward the surface to be coated in a belt shape, whereby the coating is performed.

In the application method using the circular slide hopper application apparatus, the slide surface terminal end and the application surface may be applied without damaging the application surface because they are arranged with a certain gap. In the manufacture of the photoreceptor 1, as a second and subsequent application method when forming a multi-layer of layers having different properties and dissolved in the same solvent so that the intermediate layer 102, the charge generating layer 103*a*, the charge transport layer 103*b*, and the surface protective layer 104 are laminated, the circular slide hopper method is preferable because the time existing in the solvent is much shorter than the dip coating method, and therefore the lower layer component hardly elutes to the upper layer side and may be applied without eluting to the application tank.

When the coating liquid for forming the surface protective layer contains a binder resin, the solvent may be removed from the coating film by drying to form the surface protective layer 103*c*.

On the other hand, when the coating liquid for forming the surface protective layer contains a raw material component of the binder resin, for example, a polymerizable compound, the surface protective layer 103*c* may be formed by reacting the reaction component in the coating film to cure the coating film. In this case, the coating film may be dried before curing of the coating film. Drying of the coating film may be performed before curing as long as it is naturally dried, but when the reaction for obtaining a cured product serving as a binder resin of the surface protective layer is a heating reaction, curing and drying of the coating film may be performed in parallel by heating.

The heating condition in this case may be appropriately selected depending on the type of the raw material component of the resin contained in the coating film, the type of the solvent, and the thickness of the coating film. When the raw material component of the binder resin is a component which is cured by irradiation with active rays, the surface protective layer 103*c* may be formed by irradiating active rays. As the active ray, ultraviolet rays or electron rays are more preferred, and ultraviolet rays are easily used and particularly preferred.

As the ultraviolet light source, any light source that generates ultraviolet rays may be used without limitation. For example, a low-pressure mercury lamp, a medium-pressure mercury lamp, a high-pressure mercury lamp, an ultra-high-pressure mercury lamp, a carbon arc lamp, a metal halide lamp, a xenon lamp, or a flash (pulse) xenon may be used. Although irradiation conditions vary depending on the respective ramps, the irradiation amount of the active ray is typically 5 to 500 $mJ/cm^2$, preferably 5 to 100 $mJ/cm^2$. The power of the lamp is preferably 0.1 kW to 5 kW, particularly preferably 0.5 kW to 3 kW.

As the electron beam source, there is no particular limitation on the electron beam irradiation apparatus, generally as an electron beam accelerator for such electron beam irradiation, those of the curtain beam system which is relatively inexpensive and large output is obtained is effectively used. The acceleration voltage during electron beam irradiation is preferably 100 to 300 kV. The absorbed dose is preferably 0.5 to 10 Mrad.

As an irradiation time for obtaining an irradiation amount of a necessary active ray, a period of 0.1 seconds to 10 minutes is preferable, and a period of 0.1 seconds to 5 minutes is more preferable from the viewpoint of working efficiency.

[Toner]

The toner used in the present invention contains at least titanic acid compound particles as an external additive. The toner used in the present invention is composed of, for example, a toner base particle and an external additive adhering to the surface of the toner base particle, and the external additive contains the titanic acid compound particles.

The toner base particles according to the present invention are particles mainly containing a binder resin, and contain, in addition to the binder resin, an internal additive such as a colorant, a releasing agent, and a charge control agent, for example.

<Toner Base Particles>

The toner base particles according to the toner used in the present invention are particles mainly containing a binder resin, and contain, in addition to the binder resin, an internal additive such as a colorant, a releasing agent, and a charge control agent, for example. Although there is no particular limitation on the binder resin used for the toner base particles, it is desirable to include a crystalline resin.

(Binder Resin)

It is preferable that the toner base particles according to the present invention contain an amorphous resin and a crystalline resin as a binder resin.

[Amorphous Resin]

As the amorphous resin according to the present invention, a known amorphous resin may be used. Specific examples thereof include a vinyl resin, a urethane resin, a urea resin, and a polyester resin. Of these, a vinyl resin is preferable because the fluctuation due to environmental differences is small.

The amorphous resin according to the present invention is a resin having no melting point and a relatively high glass transition temperature (Tg) when differential scanning calorimetry (DSC) is performed on the resin.

The content of the amorphous resin in the binder resin is preferably in the range of 80 to 95% by mass based on the total amount of the binder resin.

The vinyl resin is not particularly limited as long as it is obtained by polymerizing a vinyl compound, and examples thereof include a (meth)acrylic ester resin, a styrene-(meth) acrylic acid ester resin, and an ethylene-vinyl acetate resin. One kind of these may be used alone, and 2 or more kinds thereof may be used in combination. In this specification, "(meth)acrylic acid" means at least one of acrylic acid and methacrylic acid. The term "(meth) acrylate" means at least one of acrylate and methacrylate.

Among the above vinyl resins, a styrene-(meth)acrylate resin is preferred in consideration of plasticity at the time of thermal fixing. Therefore, in the following, a styrene-(meth) acrylic acid ester resin (hereinafter, also referred to as "styrene-(meth)acrylic resin") as an amorphous resin will be described.

The styrene-(meth)acrylic resin is formed by addition polymerization of at least a styrene-based monomer and a (meth)acrylic acid ester monomer. The styrene-based monomer referred to here includes a structure having a known side chain or functional group in the styrene structure, in addition to the styrene represented by the structural formula of $CH_2{=}CH{-}C_6H_5$. Further, the (meth)acrylic acid ester monomer referred to here is an acrylic acid ester compound or a methacrylic acid ester compound represented by $CH_2{=}CHCOOR$ (R is an alkyl group), as well as an acrylic acid ester derivative or a methacrylic acid ester. It contains an ester compound having a known side chain or functional group in the structure of a derivative. In addition, the (meth)acrylic ester monomer referred to here includes, in addition to an acrylic ester compound or a methacrylic ester compound represented by $CH_2$=CHCOOR (R is an alkyl group), an ester compound having a known side chain or a functional group in a structure of an acrylic ester derivative or a methacrylic ester derivative.

An example of a styrene-based monomer and a (meth) acrylic ester monomer capable of forming a styrene-(metha) acrylic resin is shown below.

Specific examples of the styrene-based monomer include, for example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene-based monomers may be used alone or in combination of 2 or more thereof.

Specific examples of the (meth)acrylate monomer include, for example, methyl (meth)acrylate, ethyl (meth) acrylate, isopropyl (meth)acrylate, n-butyl (meth)acrylate, t-butyl (meth)acrylate, isobutyl (meth)acrylate, n-octyl (meth)acrylate, 2-ethylhexyl (meth)acrylate, stearyl (meth) acrylate, lauryl (meth)acrylate, phenyl (meth)acrylate, diethylaminoethyl methacrylate, and dimethylaminoethyl methacrylate. These (meth)acrylic ester monomers may be used alone or in combination of 2 or more.

The content ratio of the constitutional unit derived from the styrene-based monomer in the styrene-(meth)acrylic resin is preferably 40 to 90% by mass based on the total amount of the resin. In addition, the content ratio of the constitutional unit derived from the (meth)acrylic ester monomer in the resin is preferably 10 to 60% by mass based on the total amount of the resin. Further, the styrene-(meth) acrylic resin may contain the following monomer compounds in addition to the above-mentioned styrene-based monomer and (meth)acrylic ester monomer.

As such a monomer compound, they are acrylic acid, methacrylic acid, maleic acid, itaconic acid, cinnamic acid, fumaric acid, and a maleic acid monoalkyl ester, for example. Examples thereof include a compound having a carboxy group such as a 2-hydroxylethyl (meth)acrylate, a 2-hydroxypropyl (meth)acrylate, a 3-hydroxypropyl (meth) acrylate, a 2-hydroxylbutyl (meth)acrylate, a 3-hydroxylbutyl (meth)acrylate, and a 4-hydroxybutyl (meth)acrylate. These monomeric compounds may be used alone or in combination of 2 or more thereof.

The content ratio of the constitutional unit derived from the above monomer compound in the styrene-(meth)acrylic resin is preferably 0.5 to 20% by mass based on the total amount of the resin.

The weight average molecular weight (Mw) of the styrene-(meth)acrylic resin is preferably 10000 to 100000. The method for producing a styrene-(meth)acrylic resin is not particularly limited, and examples thereof include a method in which an optional polymerization initiator such as a peroxide, a persulfide, a persulfate, or an azo compound commonly used for polymerization of the above monomer is used, and polymerization is performed by a known polymerization method such as lump polymerization, solution polymerization, emulsion polymerization, miniemulsion method, or dispersion polymerization method. In addition, for the purpose of adjusting the molecular weight, a commonly used chain transfer agent can be used. The chain transfer agent is not particularly limited, and examples thereof include alkyl mercaptans such as n-octyl mercaptan and mercapto fatty acid esters.

The glass transition temperature (Tg) of the styrene-(meth)acrylic resin is not particularly limited, but is preferably from 25 to 60° C., from the viewpoint of reliably obtaining fixability such as low-temperature fixability and heat resistance such as heat-resistant storage property and blocking resistance.

Further, in order to decrease the mechanical strength of the toner and suppress the burial of the external additive, it is preferable to use an amorphous polyester resin (hereinafter, simply referred to as "polyester resin") in combination.

The polyester resin according to the present invention is produced by a polycondensation reaction using a polyvalent carboxylic acid (derivative) and a polyhydric alcohol (derivative) as raw materials in the presence of an appropriate catalyst.

A polyvalent carboxylic acid is a compound containing 2 or more carboxy groups in 1 molecule. As the polyvalent carboxylic acid derivative, an alkyl ester of a polyvalent carboxylic acid, an acid anhydride and an acid chloride may be used, and as the polyhydric alcohol derivative, an ester compound of a polyhydric alcohol and a hydroxycarboxylic acid may be used.

Examples of the polyvalent carboxylic acid include two valent carboxylic acids such as oxalic acid, succinic acid, maleic acid, adipic acid, β-methyladipic acid, azelaic acid, sebacic acid, nonandicarboxylic acid, decandicarboxylic acid, undecandicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucilage acid, phthalic acid, isophthalic acid, terephthalic acid, tetrachlorophthalic acid, chlorophthalic acid, nitrophthalic acid, p-carboxyphenylacetic acid, p-phenylene diacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracendicarboxylic acid, anddodecenylsuccinic acid; and 3 or more valent carboxylic acids such as trimellitic acid, pyromellitic acid, naphthalenetricarboxylic acid, naphthalenetetracarboxylic acid, pyrentricarboxylic acid, and pyrenetetracarboxylic acid.

As the polyvalent carboxylic acid, an unsaturated aliphatic dicarboxylic acid such as fumaric acid, maleic acid, or mesaconic acid is preferably used. In addition, in the present invention, an anhydride of a dicarboxylic acid such as maleic anhydride may also be used.

The polyhydric alcohol is a compound containing 2 or more hydroxy groups in 1 molecule. Examples of the polyhydric alcohol include divalent alcohols such as ethylene glycol, propylene glycol, butanediol, diethylene glycol, hexanediol, cyclohexanediol, octanediol, decanediol, dodecanediol, ethylene oxide adduct of bisphenol A, propylene oxide adduct of bisphenol A; and trivalent or more polyols such as glycerin, pentaerythritol, hexamethylolmelamine, hexaethylmelamine, tetramethylolbenzoguanamine, and tetraethylbenzoguanamine.

Further, regardless of the above-mentioned amorphous resin, a crystalline resin may be used in combination from the viewpoint of low-temperature fixability. When the binder resin contains an amorphous resin and a crystalline resin, a matrix in which the amorphous resin is a continuous phase is formed in the obtained toner base particles, and the crystalline resin forms a domain isolated and dispersed in the matrix.

[Crystalline Resin]

As the crystalline resin according to the present invention, a conventionally known crystalline resin in the art may be used. As the crystalline resin, a crystalline polyester resin is preferred.

The crystalline resin according to the present invention refers to a resin having a distinct endothermic peak rather than a stepped endothermic change in differential scanning calorimetry (DSC). Specifically, the clear endothermic peak means a peak in which the half-value width of the endothermic peak is 15° C. or less when measured at a temperature rising rate of 10° C./minute, for example, in differential scanning calorimetry (DSC).

Examples of the crystalline resin include a crystalline polyester resin and a crystalline vinyl-based resin. Although not particularly limited, a crystalline polyester resin is preferred for realizing low-temperature fixability, and a known crystalline polyester resin obtained by a polycondensation reaction of a carboxylic acid having 2 or more valences (polyvalent carboxylic acid) and an alcohol having 2 or more valences (polyhydric alcohol) may be used.

The content of the crystalline resin, for example, the crystalline polyester resin in the binder resin is preferably in the range of 5 to 20% by mass based on the total amount of the binder resin. When the content of the crystalline resin is less than 5% by mass, low-temperature fixability is difficult to obtain. Further, when the content of the crystalline resin is more than 20% by mass, toner base particles may be hardly produced.

(Crystalline Polyester Resin)

There is no particular limitation on the crystalline polyester resin used in the binder resin, and conventionally known crystalline polyester resins in the present technical field may be used.

Specific examples of the polyvalent carboxylic acid used for producing the crystalline polyester resin include saturated aliphatic dicarboxylic acids such as oxalic acid, malonic acid, succinic acid, adipic acid, azelaic acid, n-dodecylsuccinic acid, nonanedicarboxylic acid, undecanedicarboxylic acid, dodecanedicarboxylic acid, and tetradecanedicarboxylic acid; alicyclic dicarboxylic acids such as cyclohexanedicarboxylic acid; aromatic dicarboxylic acids such as phthalic acid, isophthalic acid, and terephthalic acid; poyvalent carboxylic acids having 3 or more valences such as trimellitic acid pyromellitic acid; anhydrides of these carboxylic acid compounds, and alkyl esters having 1 to 3 carbon atoms. One kind of these may be used alone, and 2 or more kinds thereof may be used in combination.

Specific examples of the polyhydric alcohol used in producing the crystalline polyester resin include aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentylglycol, and 1,4-butenediol; and polyhydric alcohols having 3 or more valences such as glycerin, pentaerythritol, trimethylolpropane, and sorbitol. One kind of these may be used alone, and 2 or more kinds thereof may be used in combination.

In the present invention, from the viewpoint of the domain of the crystalline polyester resin, when the number of carbon atoms of the main chain of the structural unit derived from the polyhydric alcohol for forming the crystalline polyester resin is $C_{alcohol}$, and the number of carbon atoms of the main chain of the structural unit derived from the polyvalent carboxylic acid for forming the crystalline polyester resin is taken as a $C_{acid}$, it is preferable to satisfy the following relational expressions (1) and (2).

$$5 \leq |C_{acid} - C_{alcohol}| \leq 12 \quad \text{Relational expression (1):}$$

$$C_{acid} > C_{alcohol} \quad \text{Relational expression (2):}$$

As the difference in the length of the alkyl chain of the polyhydric alcohol and the polyvalent carboxylic acid increases, the crystalline polyester resin hardly aggregates, so that the crystalline dispersion becomes possible. For this reason when $|C_{acid} - C_{alcohol}|$ is less than 5, a larger domain is formed in the matrix. When $|C_{acid} - C_{alcohol}|$ is greater than 12, a smaller domain is formed in the matrix.

The melting point Tm of the crystalline polyester resin is preferably in the range of 65 to 90° C. When the melting point Tm of the crystalline polyester resin is in the range of 65 to 90° C., the low-temperature fixability is not inhibited, and the heat-resistant storage property is improved.

In the present invention, the melting point of the crystalline polyester resin is a value measured as follows. That is, using a differential scanning calorimeter "Diamond DSC" (manufactured by Perkin Elmer Co.), the following processes are performed: the first heating process of raising the temperature from 0° C. to 200° C. at an elevating speed of 10° C./min, the cooling process of cooling from 200° C. to 0° C. at a cooling rate of 10° C./min, and the second heating process of raising the temperature from 0° C. to 200° C. at an elevating speed of 10° C./min. It is intended to be measured by the measurement conditions (heating and cooling conditions) passing through this order. On the basis of the DSC curve obtained by this measurement, the endothermic peak top temperature derived from the crystalline polyester resin in the first temperature rise process is defined as the melting point (Tm). As a measurement procedure, 3.0 mg of a measurement sample (crystalline polyester resin) is enclosed in an aluminum pan and set in a diamond DSC sample holder. An empty aluminum pan is used as a reference.

(Hybrid Resin)

In the toner base particles, it is preferable that the crystalline resin that forms a domain in the matrix includes a vinyl-based polymerization segment, for example, a crystalline resin formed by chemically bonding a styrene-(meth) acrylic polymerization segment and a polyester polymerization segment (also simply referred to as "hybrid resin"). At this time, the vinyl-based polymerization segment, preferably the styrene-(meth)acrylic polymerization segment and the polyester polymerization segment, are preferably crystalline resins bonded via both reactive monomers. By hybridizing the crystalline polyester resin with a vinyl-based polymerization segment, preferably a styrene-(meth)acrylic polymerization segment, the interface between the domain and the matrix becomes smooth, and the dispersibility of the crystalline resin becomes good.

The vinyl-based polymerization segment constituting the hybrid resin is composed of a resin obtained by polymerizing a vinyl-based monomer, for example, a styrene-(meth) acrylic resin. Here, as the vinyl-based monomer, those described above as monomers constituting the vinyl-based resin may be used in the same manner, and therefore, a detailed description thereof will be omitted here. Note that the content of the vinyl-based polymerization segment in the hybrid resin is preferably in the range of 0.5 to 20% by mass.

The polyester polymerization segment constituting the hybrid resin is composed of a crystalline polyester resin produced by performing a polycondensation reaction in the presence of a catalyst with a polyvalent carboxylic acid and a polyhydric alcohol. Here, specific types of the polyvalent carboxylic acid and the polyhydric alcohol are as described above, and therefore, detailed description thereof will be omitted here.

An "bireactive monomer" is a monomer that binds a polyester polymerization segment to a vinyl polymerized segment. It is a monomer having both of a group selected from a hydroxy group, a carboxy group, an epoxy group, a primary amino group and a secondary amino group forming a polyester polymerization segment, and an ethylenically unsaturated group forming a vinyl-based polymerization segment in the molecule. The bireactive monomer is preferably a monomer having a hydroxy group or a carboxy group and an ethylenically unsaturated group. Further preferably, it is a monomer having a carboxy group and an ethylenically unsaturated group. In other words, it is preferably a vinyl-based carboxylic acid.

Specific examples of the bireactive monomer include acrylic acid, methacrylic acid, fumaric acid, and maleic acid, and may be the esters of hydroxyalkyl (1 to 3 carbon atoms), but acrylic acid, methacrylic acid, or fumaric acid is preferred from the viewpoint of reactivity. A polyester polymerization segment and a vinyl-based polymerization segment are bonded via the bireactive monomer.

The amount of the bireactive monomer to be used is preferably 1 to 10 parts by mass, more preferably 4 to 8 parts by mass, per 100 parts by mass of the total amount of the vinyl-based monomers constituting the vinyl-based polymerization segment, from the viewpoint of improving the low-temperature fixability, the high-temperature offset resistance, and the durability of the toner.

As a method of producing a hybrid resin, an existing general scheme may be used. Representative methods include the following three methods.

(1) A method of forming a hybrid resin by polymerizing a polyester polymerization segment in advance, then reacting a bireactive monomer with the polyester polymerization segment, and further reacting a styrene-based vinyl monomer for forming a vinyl-based polymerization segment (e.g., a styrene-(meth)acrylic resin) and a (meth)acrylic acid ester monomer.

(2) A method of forming a polyester polymerization segment by polymerizing a vinyl-based polymerization segment in advance, then reacting a bireactive monomer with the vinyl-based polymerization segment, and further reacting a polyvalent carboxylic acid and a polyhydric alcohol for forming a polyester polymerization segment.

(3) A method in which a polyester polymerization segment and a vinyl-based polymerization segment are polymerized in advance, respectively, then a bireactive monomer is reacted with these, thereby bonding them together.

In the present invention, any of the above manufacturing methods may be used, but preferably, the method of the above (2) section is preferred. Specifically, the following is a preferable method. A polyvalent carboxylic acid and a polyhydric alcohol for forming a polyester polymerization segment and a vinyl-based monomer and a bireactive monomer for forming a vinyl-based polymerization segment are mixed, and then, a polymerization initiator is added. Then, a vinyl-based polymerization segment is formed by polymerizing the vinyl-based monomer and the bireactive monomer, and further, an esterification catalyst is added to perform a polycondensation reaction.

Here, various conventionally known catalysts may be used as a catalyst for synthesizing a polyester polymerization segment. Further, examples of the esterification catalyst include tin compounds such as dibutyltin oxide and 2-ethylhexanoic acidtin(II) and titanium compounds such as titanium diisopropylate bistriethanolaminate. Examples of the esterification cocatalyst include gallic acid.

(Colorant)

The toner base particles according to the present invention may contain a colorant. As the colorant, a known colorant as shown below may be used depending on the color of the toner. The content of the colorant contained in the toner base particles is preferably 1 to 10 parts by mass, more preferably 2 to 8 parts by mass, per 100 parts by mass of the binder resin.

Examples of the colorant used in yellow toners include C.I. Solvent Yellow 19, 44, 77, 79, 81, 82, 93, 98, 103, 104, 112, 162, C.I. Pigment Yellow 14, 17, 74, 93, 94, 138, 155, 180, 185. These may be used alone or in combination of 2 or more kinds thereof. Among these, C.I. Pigment Yellow 74 is particularly preferable.

Examples of the colorant used in magenta toners include C.I. Solvent Red 1, 49, 52, 58, 63, 111, 122, C.I. Pigment Red 5, 48:1, 53:1, 57:1, 122, 139, 144, 149, 166, 177, 178, 222. These may be used alone or in combination of 2 or more thereof. Among these, C.I. Pigment Red 122 is particularly preferable.

Examples of the colorant used in cyan toners include C.I. Pigment Blue 15:3.

Examples of the colorant used in black toners include carbon black, a magnetic material, and titanium black. Examples of the carbon black include channel black, furnace black, acetylene black, thermal black, and lamp black. Examples of the magnetic material include iron, nickel, ferromagnetic metals such as cobalt, alloys containing these ferromagnetic metals, ferrite, compounds of ferromagnetic metals such as magnetite, and ferromagnetic metals by heat treatment without containing ferromagnetic metals. Examples of the alloy exhibiting ferromagnetism by heat treatment include Hensler alloys such as manganese-copper-aluminum, manganese-copper-tin, and chromium dioxide.

(Releasing Agent)

The toner base particles according to the present invention may contain a releasing agent if necessary. Examples of the releasing agent include dialkyl ketone waxes such as polyethylene wax, paraffin wax, microcrystalline wax, Fisher Tropsh wax, and distearyl ketone; easer waxes such as Carnauba wax, Montan wax, behenyl behenate, trimethylol propanetribehenate, pentaerythritol tetramyristate, pentaerythritol tetrastearylate, pentaerythritol tetrabehenate, pentaerythritol diacetate dibehenate, glycerin tribehenate, 1,18-octadecanediol distearate, tristearyl trimellitic acid, and distearyl maleate; and amide-based waxes such as ethylenediamine dibehenylamide, and trimellitic acid tristearyl amide.

The content ratio of the releasing agent in the toner base particle is preferably in the range of 2 to 30 parts by mass, and more preferably in the range of 5 to 20 parts by mass with respect to 100 parts by mass of the binder resin.

(Charge Control Agent)

A charge control agent may be added to the toner base particles according to the present invention if necessary. As the charge control agent, various known ones may be used. As the charge control agent, various known compounds which may be dispersed in an aqueous medium may be used, and specific examples thereof include a nigrosine-based dye, a metal salt of a naphthenic acid or a higher fatty acid, an alkoxylated amine, a quaternary ammonium salt compound, an azo-based metal complex, a salicylate metal salt, or a metal complex thereof. The content ratio of the charge control agent is preferably 0.1 to 10 parts by mass, more preferably 0.5 to 5 parts by mass, per 100 parts by mass of the binder resin.

<External Additive>

The toner used in the present invention contains titanic acid compound particles as an external additive. The toner according to the present invention may contain only titanic acid compound particles as an external additive, and may contain components other than the titanic acid compound particles.

(Titanic Acid Compound Particles)

As the titanic acid compound constituting the titanic acid compound particles, potassium titanate, barium titanate, strontium titanate, calcium titanate, magnesium titanate, lead titanate, aluminum titanate, and lithium titanate are preferably used. From the viewpoint of easily controlling the size of the particle diameter, calcium titanate, strontium titanate, magnesium titanate, and barium titanate particles are particularly preferably used.

It is preferable that the titanic acid compound further contains lanthanum. By containing lanthanum, the resistance of the titanic acid compound particles is lowered, the charge amount of the toner may be adjusted to be lower, and the adhesion of the toner to the photoreceptor may be reduced. The titanic acid compound particles have a rectangular parallelepiped shape due to the perovskite crystal structure, but the crystal structure may be changed by containing lanthanum to approximate the particle shape to a spherical shape. As a result, scratches do not easily occur on the surface of the photoreceptor, and wear resistance of the photoreceptor may be secured.

The content ratio of lanthanum in the titanic acid compound containing lanthanum is preferably in the range of 3.4 to 14.9% by mass. When the lanthanum content is 3.4% by mass or more, the lanthanum content is close to a spherical shape and the abrasiveness may be further reduced. On the other hand, by setting the lanthanum content to 14.9% by mass or less, the particle size may be easily controlled, so that the generation of coarse particles may be prevented and the abrasiveness may be easily reduced.

The content ratio of lanthanum in the titanic acid compound containing lanthanum may be measured by, for example, the following method. The following description is an explanation using strontium titanate containing lanthanum as an example.

First, a plurality of mixtures of lanthanum titanate and strontium titanate having different compositions are prepared, and a calibration curve is prepared by measuring peak intensities using a scanning type fluorescent X-ray analyzer "ZSX Primus IV" (manufactured by Rigaku Corporation) as a specimen. As a specific measurement method, a sample 2 g is filled into a tablet molded ring having a diameter of 20 mm, and the tablet is pressurized and pelletized, and then the measurement is performed under the following conditions.

(X-Ray Generator Conditions)

Target: Rh

Tube voltage: 50 kV (Spectral Conditions)

Slit: S2

Spectral crystal: LiF

Detector: SC

The content ratio of lanthanum in the specimen (strontium titanate particles containing lanthanum) having an unknown content ratio of lanthanum is subjected to fluorescence X-ray analysis in the same manner as in the above specimen, and from the obtained peak intensity, the content (mass %) of lanthanum and strontium of the specimen is determined using the above calibration curve, and may be further calculated by the following formula using these.

Lanthanum content ratio (mass %)=Lanthanum (mass %)/(Lanthanum (mass %)+Strontium (mass %))

Further, the titanic acid compound particles used in the present invention, preferably the titanic acid compound particles containing lanthanum, may be surface-modified, for example, as described later. Hereinafter, in the case of the titanic acid compound particles, the titanic acid compound particles containing lanthanum are included in the category.

The content of the titanium acid compound particles in the toner according to the present invention is appropriately selected in consideration of the required performance of the toner. The content of the titanium acid compound particles is preferably in the range of 0.1 to 1.5% by mass, and more preferably in the range of 0.1 to 1.0% by mass, based on the total amount of the toner base particles and the external additive. When the content of the titanium acid compound particles is within the above range, it is possible to obtain an effect of suppressing variation in the charge amount under different temperature and humidity environments.

The number average primary particle diameter of the titanium acid compound particles is preferable in the range of 10 to 200 nm, and more preferably in the range of 10 to 100 nm. By setting the number average primary particle diameter of the titanium acid compound particles to 10 nm or more, the function as a charge control agent is effectively expressed, and by setting the number average primary particle diameter to 200 nm or less, it is possible to prevent the polishing property from being too strong. The number average primary particle diameter of the titanium acid compound particles is a number average primary particle diameter measured by the following method.

Using a scanning electron microscope (SEM) "JEM-7401F" (manufactured by JEOL Ltd.), SEM photographs of toners magnified 40,000 times are taken, and the SEM photographs are observed to measure the particle diameter (Feret diameter) of the primary particles of the titanic acid compound particles. The particle diameter is measured by selecting an area in which the total number of particles is about 100 to 200 in the SEM image, and 100 particles are measured from the area, and the average value is the number average primary particle diameter.

The average circularity of the titanium acid compound particles is preferably in the range of 0.82 to 1.0. By setting it within this range, the fluidity may be improved and the abrasive property may be prevented from being excessively strong. The average circularity of the titanium acid compound particles may be measured by the following method.

Measurement of the average circularity of the titanic acid compound particles is done as follows. A scanning electron microscope "JSM-7401F" (manufactured by JEOL Ltd.) is used for taking a photograph of 40000 times for 100 titanic acid compound particles. The photographic image is taken by a scanner, image analysis is performed by using the image processing analyzer "LUZEX (registered trademark) AP" (manufactured by Nireco Co., Ltd.)

The circularity of each external additive (titanic acid compound particles) is determined according to the following Equation (1) after obtaining the circularity equivalent diameter circumference and circumference from the analyzed image, and the circularity is averaged.

Circularity=Circular equivalent diameter circumference/Circumference=$[2\times(A\pi)^{1/2}]/PM$ Equation (1):

In the above Equation, "A" represents a projected area of an external additive (titanium acid compound particles), and "PM" represents a peripheral length of an external additive (titanium acid compound particles). When the circularity is 1.0, it is a true sphere, and the lower the value, the more uneven the outer circumference and the higher the degree of irregularity.

The titanium acid compound particles may be produced by the following method using strontium titanate particles as an example. However, the manufacturing method is merely an example, and the method for producing the titanium acid compound particles is not limited thereto.

Strontium titanate particles which may be used as an external additive may be synthesized by adding strontium hydroxide to a titania sol dispersion obtained by adjusting the pH of a hydrous titanium oxide slurry obtained by hydrolyzing an aqueous solution of titanyl sulfate. It may be synthesized by heating the mixture to a reaction temperature. By adjusting the pH of the hydrous titanium oxide slurry in the range of 0.5 to 1.0, a titania sol having a good crystallinity and a particle diameter may be obtained.

In addition, for the purpose of removing ions adsorbed on the titania sol particles, it is preferable to add an alkaline substance such as sodium hydroxide, for example, to the dispersion of the titania sol. At this time, in order to prevent sodium ions from being adsorbed on the surface of the hydrous titanium oxide, it is preferable that the slurry is not made more than pH 7. In addition, the reaction temperature is preferably 60 to 100° C., and in order to obtain a desired particle size distribution, the temperature rise rate is preferably 30° C./time or less, and the reaction time is preferably 3 hours or more and 7 hours or less.

When an example of the production method is shown. The hydrous titanium oxide obtained by hydrolysis of titanyl sulfate is washed with an aqueous alkali solution. Then, hydrochloric acid is added to the slurry of hydrous titanium oxide to obtain a titania sol dispersion. NaOH is added to the titania sol dispersion to obtain a hydrous titanium oxide. $Sr(OH)_2.8H_2O$ is added to the hydrous titanium oxide, then nitrogen-gas replacement is carried out, and distilled water is added. The slurry in a nitrogen atmosphere was heated to 80° C., and the reaction is carried out at 80° C. for 6 hours. After the reaction, the mixture is cooled to room temperature, and washing is repeated, and then filtered and dried to obtain strontium titanate particles which have not been passed through a sintering step. Thus by the manufacturing method without passing through the firing step (wet method), it is possible to obtain cubic and rectangular parallelepiped strontium titanate particles.

In addition, amorphous strontium titanate particles may be obtained by passing through the firing step (calcination method). For example, strontium carbonate and titanium oxide are taken approximately equimolar, mixed by a ball mill, pressure molded, and calcined at 1000° C. or higher and 1500° C. or lower, and then, after mechanical grinding, it may be produced by classifying. The shape and the particle size may be adjusted by appropriately changing the raw material, raw material composition, molding pressure, firing temperature, grinding, and classification.

In addition, the titanium acid compound particles containing lanthanum may be produced by the following method, taking as an example the lanthanum-containing strontium titanate particles. However, the manufacturing method is merely an example, and the method for producing the lanthanum containing titanium acid compound particles is not limited thereto.

Strontium titanate particles containing lanthanum which may be used as an external additive are typically produced by a method of producing a perovskite titanium acid compound by an ordinary pressure heating reaction method. In this method, a mineral acid deflocculated product of a hydrolysate of a titanium compound is used as a titanium dioxide source, and a water-soluble acidic compound is used as a strontium source and a lanthanum source, and the mixture is reacted with a mixture thereof while adding an aqueous alkali solution at 50° C. or higher.

As the above titanium dioxide source, a mineral acid deflocculated product of a hydrolysate of a titanium compound is used. Specifically, it is preferable to use a material obtained by peptizing metatitanic acid having a $SO_3$ content of 1.0% by mass or less, preferably 0.5% by mass or less, by adjusting the pH to 0.8 to 1.5 with hydrochloric acid, because strontium titanate particles having good particle size distribution may be obtained.

As the above-mentioned strontium source, strontium nitrate, or strontium chloride may be used. As the above-mentioned lanthanum source, lanthanum nitrate hexahydrate, or lanthanum chloride heptahydrate may be used. As the above aqueous alkali solution, an aqueous sodium hydroxide solution is preferred although caustic alkali may be used.

In the above manufacturing method, as a factor affecting the particle diameter of strontium titanate particles containing lanthanum obtained, there may be mentioned a titanium dioxide source, a mixing ratio of a strontium source and a lanthanum source at the time of the reaction, a titanium dioxide source density at an initial stage of the reaction, a temperature and an addition rate when an aqueous alkali solution is added, and may be appropriately adjusted to obtain a target particle diameter and a particle size distribution.

In order to prevent the formation of strontium carbonate in the reaction process, it is preferable to prevent the incorporation of carbon dioxide gas by reacting under a nitrogen gas atmosphere.

The molar ratio of the strontium source and the lanthanum source to the titanium dioxide source during the reaction is preferably in the range of 0.9 to 1.4 by $(Sr^{2+}+La^{3+})/T^{4+}$, and particularly preferably in the range of 0.95 to 1.15. The content ratio of lanthanum in strontium titanate containing lanthanum may be adjusted by the blending ratio at the time of the reaction.

The molar concentration of the titanium dioxide source ($TiO_2$) at the early stage of the reaction is preferably in the range of 0.05 to 1.0 mol/L, and particularly preferably in the range of 0.1 to 0.8 mol/L.

The higher the temperature when an alkaline aqueous solution is added, the better the crystallinity is obtained, but practically, it is suitable to be in the range of 50 to 100° C. The addition rate of the aqueous alkali solution mostly affects the particle size of the obtained particles, strontium titanate particles containing lanthanum having a larger particle size are obtained as the addition rate is slower, and strontium titanate particles containing lanthanum having a smaller particle size are obtained as the addition rate is faster. The addition rate of the alkaline aqueous solution is preferably 0.001 to 2.0 equivalents/h, more preferably 0.005 to 1.0 equivalents/h, with respect to the charged raw material, and is appropriately adjusted according to the particle size to be obtained. The addition rate of the alkaline aqueous solution may also be changed in the middle depending on the purpose.

Further, as a method of surface modification when the titanium acid compound particles are surface-modified, for example, a method of modifying the surface of the titanium acid compound particles using a surface modifier may be mentioned.

As the surface modifier used for the surface modification, an alkylsilazane-based compound such as hexamethyldisilazane, an alkylalkoxysilane-based compound such as dimethyldimethoxysilane, dimethyldiethoxysilane, trimethylmethoxysilane, methyltrimethoxysilane, isobutyltrimethoxysilane, and butyltrimethoxysilane, a chlorosilane-based compound such as dimethyldichlorosilane, trimethylchlorosilane, a silicone oil, and a silicone varnish may be used. One kind of these surface modifier may be used alone, or 2 or more kinds thereof may be mixed and used.

Further, as a specific treatment method, for example, a method in which a surface modifier is sprayed onto the titanium acid compound particles according to the present invention or a surface modifier vaporized is mixed and subjected to heat treatment may be mentioned. At this time, water, an amine, or other catalyst may be used. Here, it is preferable that this dry surface modification is performed under an inert gas atmosphere such as nitrogen.

Further, a surface modifier is dissolved in a solvent, and the titanium acid compound particles according to the present invention are mixed and dispersed therein, and then, if necessary, a heat treatment is performed, and further a drying treatment is performed to obtain titanium acid compound particles having a modified surface. Here, the surface modifier may be added after mixing and dispersing the titanium acid compound particles in a solvent, or it may be added simultaneously.

(Other External Additives)

Other external additives may be added to the toner according to the present invention for the purpose of improving fluidity and chargeability in addition to the titanium acid compound particles according to the present invention as long as the effect is not inhibited. Examples of other external additives include known inorganic fine particles and organic fine particles. When inorganic fine particles or organic fine particles are externally added in addition to the titanium acid compound particles, the amount thereof is preferably about 0.1 to 10% by mass based on the total amount of the toner.

The external additive used may be 1 or 2 or more. 2 or more of the external additives having different particle diameters may be used. Different particle diameters have different roles as external additives, and in general, the larger the diameter, the more the spacer effect is exerted, the lower the adhesion force between the toners is, and the smaller the diameter, the easier it is to cover the surface of the toner base particles, so that the fluidity may be raised. In addition, as for the shape, not only a spherical external additive but also a needle-like material represented by titanium oxide (titania) having a rutile-type crystal structure may be used without limitation, such as an indefinite shape, a spindle shape, a gold flat sugar shape, a plate shape, or a scaly material.

Examples of the above inorganic fine particles include silica fine particles, titania fine particles, zirconia fine particles, zinc oxide fine particles, chromium oxide fine particles, cerium oxide fine particles, antimony oxide fine particles, tungsten oxide fine particles, tin oxide fine particles, tellurium oxide fine particles, manganese oxide fine particles and boron oxide fine particles.

Among these, silica fine particles are preferably used. The silica fine particles are preferably silica fine particles produced by a sol-gel method. The silica fine particles produced by the sol-gel method have a uniform particle size (a narrow particle size distribution, that is, a monodispersion) as compared with fumed silica which is a general manufacturing method, so that the particle diameter may be easily adjusted and is preferable.

The number average primary particle diameter of the inorganic fine particles is preferable in the range of 3 to 200 nm, and more preferably in the range of 5 to 100 nm. The number average primary particle diameter of the inorganic fine particles may be measured by the same method as the number average primary particle diameter of the titanium acid compound particles.

The inorganic fine particles described above may be subjected to a surface hydrophobization treatment by a known surface modifier, if necessary. By the hydrophobization treatment, it is possible to suppress the adhesion of the toner base particles to each other due to moisture adsorption, which is generated, for example, due to the hydroxy group present on the surface of the inorganic fine particles.

The surface modifier used may be 1 or 2 or more kinds. Examples of the surface modifier include a silane coupling agent, a silicone oil, a titanate-based coupling agent, an aluminate-based coupling agent, a fatty acid, a fatty acid metal salt, an ester product thereof, and a Rosin acid.

Examples of the above silane coupling agent include dimethyldimethoxysilane, hexamethyldisilazane (HMDS), methyltrimethoxysilane, isobutyltrimethoxysilane and decyltrimethoxysilane.

Examples of the above silicone oil include cyclic, linear or branched organosiloxanes. More specifically, organosiloxane oligomers, octamethylcyclotetrasiloxane, decamethylcyclopentasiloxane, tetramethylcyclotetrasiloxane, and tetravinyltetramethylcyclotetrasiloxane are included.

The amount of the surface modifier used for the hydrophobization treatment of the surface is preferably an amount in which the carbon content ratio in the inorganic fine particles after the hydrophobization treatment is in the range of 0.1 to 10% by mass.

The organic fine particles include spherical organic fine particles having a number average primary particle diameter of about 10 to 2000 nm. Specifically, a homopolymer such as styrene or methyl methacrylate or organic fine particles by these copolymers may be used.

In addition, a lubricant may be externally added to the toner base particles for the purpose of reducing the frictional force between the photoreceptor and the cleaning blade. When a lubricant is externally added, the amount thereof is preferably about 0.1 to 2.0% by mass based on the total amount of the toner.

As the lubricant, a known fatty acid metal salt may be used. From the viewpoint of spreadability, a fatty acid metal salt having a Mohs hardness of 2 or less is preferred, and as such a fatty acid metal salt, a metal salt selected from zinc, calcium, magnesium, aluminum, and lithium is preferred.

Of these, zinc fatty acid, calcium fatty acid, lithium fatty acid or magnesium fatty acid are particularly preferred. Further, as the fatty acid of the fatty acid metal salt, a higher fatty acid having 12 to 22 carbon atoms is preferred. When a fatty acid having 12 or more carbon atoms is used, generating of free fatty acids may be suppressed, and when the number of carbon atoms of the fatty acid is 22 or less, the melting point of the fatty acid metal salt does not become too high, and good fixability may be obtained. As the fatty acid, stearic acid is particularly preferred, and as the fatty acid metal salt used in the present invention, zinc stearate, calcium stearate, lithium stearate are preferable, and zinc stearate is more preferable, from the viewpoint of spreadability. These fatty acid metal salts may be used in combination of 2 or more kinds.

As the number average particle diameter of the fatty acid metal salt, a range of 20 μm or less is preferred, and a range of 2.0 μm or less is particularly preferred.

<Production of Toner>

The toner according to the present invention is obtained by adhering the above-mentioned external additive to the surface of the toner base particles described above.

The toner base particles according to the present invention may be produced by a known method such as a kneading and pulverizing method, a suspension polymerization method, an emulsion aggregation method, a dissolution suspension method, a polyester extension method, or a dispersion polymerization method. Among these, it is preferable to employ an emulsification aggregation method. According to the emulsion aggregation method, it is possible to obtain toner base particles having a sharp particle size distribution and highly controlled particle size and toner circularity.

The emulsion aggregation method is a method for forming toner base particles by mixing a dispersion of fine particles of a binder resin (hereinafter, also referred to as "binder resin fine particles") dispersed by a surfactant or a dispersion stabilizer with a dispersion of various fine particles to be contained in the toner base particles, for example, a dispersion of fine particles of a colorant and a dispersion of fine particles of various components as an optional component, aggregating the mixture until the particle size becomes a desired particle size of the toner base particles by adding a flocculant, and then or simultaneously with aggregation, fusing between the binder resin fine particles is performed and shape control is performed.

In the production of a toner according to the present invention, an example of a production method in which toner base particles containing a colorant are produced by an emulsion aggregation method is described below. In a method for producing toner base particles by an emulsion aggregation method, the following steps (1) to (5) are included, and an external additive is externally added to the toner base particles by the step (6).

(1) A step of preparing a dispersion liquid in which colorant fine particles are dispersed in an aqueous medium;

(2) A step of preparing a dispersion liquid in which fine binder resin particles containing an internal additive, if necessary, are dispersed in an aqueous medium;

(3) A step of mixing a dispersion of the colorant fine particles and a dispersion of the binder resin fine particles to aggregate, associate, and fuse the colorant fine particles and the binder resin fine particles to form toner base particles;

(4) A step of filtering out the toner base particles from the dispersion system (aqueous medium) of the toner base particles and removing the surfactant;

(5) A step of drying the toner base particles; and (6) A step of adding an external additive to the toner base particles.

The dispersions prepared in (1) and (2) of the above production method may contain a surfactant or a dispersion stabilizer if necessary. Preparation of the dispersion may be carried out utilizing mechanical energy. The disperser for performing dispersion is not particularly limited, and include a low-speed shear type disperser, a high-speed shear type disperser, a friction type disperser, a high-pressure jet type disperser, an ultrasonic wave disperser such as an ultrasonic wave homogenizer, and a high-pressure shock type disperser Ultimizer™

In the toner base particle according to the present invention, when the binder resin contains an amorphous resin and a crystalline resin, as the dispersion liquid of the binder resin particles, a dispersion liquid obtained by mixing a dispersion liquid of particles of an amorphous resin (hereinafter, also referred to as "amorphous resin particles") and a dispersion liquid of particles of a crystalline resin (hereinafter, also referred to as "crystalline resin particles") so that the ratio of the amorphous resin particles and the ratio of the crystalline resin particles becomes the ratio described above is used.

The particle size of the binder resin particles used for the toner base particles is preferably in the range of about 50 to 300 nm in both of the amorphous resin particles and the crystalline resin particles with a median diameter on a volume basis. The median diameter on a volume basis of the binder resin particles may be measured by an electrophoretic light scattering photometer, for example, "ELS-800 (manufactured by Otsuka Electronics Co., Ltd.)".

In the step (3) of the above production method, aggregation is slowly performed while balancing the repulsive force on the surface of fine particles by pH adjustment and the cohesive force due to the addition of an aggregating agent composed of an electrolyte body, and association is performed while controlling the average particle diameter and the particle size distribution, and at the same time, fusion between fine particles is performed by heating and stirring to perform shape control, thereby forming toner base particles.

The flocculant used in the present invention is not particularly limited, but one selected from salts of metals is suitably used. Examples thereof include salts of monovalent metals of alkali metals such as sodium, potassium, and lithium, salts of divalent metals such as calcium, magnesium, manganese, and copper, and salts of trivalent metals such as iron and aluminum. Specific salts thereof include sodium chloride, potassium chloride, lithium chloride, calcium chloride, magnesium chloride, zinc chloride, copper sulfate, magnesium sulfate, and manganese sulfate. Of these, a salt of a divalent metal is particularly preferred. The use of salts of divalent metals allows the aggregation to proceed in smaller quantities. These may be used alone, or in combination of 2 or more kinds.

In the step (4), the toner base particles are solid-liquid separated from the dispersion of the toner base particles using a solvent such as water. Washing is performed to remove deposits such as surfactants from a cake-like aggregate containing filtered toner base particles. Specific methods of solid-liquids separation and washing include, but are not limited to, a centrifugal separation method, a reduced filtration method using an aspirator, or a Nutche, and filtration methods using filter presses. At this time, pH adjustment and pulverization may be appropriately performed. Such an operation may be repeated.

The dryers used in the drying step (5) include, but are not limited to, an oven, a spray drier, a vacuum freeze-drier, a reduced-pressure drier, a static shelf dryer, a mobile shelf dryer, a liquid-bed dryer, a revolver dryer, and a stirred dryer. The water content measured by the Karl Fischer titration method in the toner base particles subjected to the drying treatment is preferably 5% by mass or less, more preferably 2% by mass or less.

The toner base particle according to the present invention may be a toner base particle having a multilayer structure such as a core-shell structure including the core particle and a shell layer covering the surface thereof, using the toner parent particle as a core particle. The shell layer may not cover the entire surface of the core base particle, and may partially expose the core particle. The cross-section of the core-shell structures may be confirmed by known observing means such as a transmission electron microscope (TEM: Transmission Electron Microscope) or a scanning probe microscope (SPM: Scanning Probe Microscope).

In the case of the core-shell structure, characteristics such as glass transition point, melting point, and hardness may be made different between the core particle and the shell layer, and it is possible to design the toner base particle according to the purpose. For example, a resin having a relatively high glass transition point (Tg) may be aggregated and fused to a surface of a core particle containing a binder resin and fine metal particles and having a relatively low glass transition point (Tg) to form a shell layer. It is preferable that the shell layer contains an amorphous resin.

The toner base particles having a core-shell structure may be obtained, for example, by the above emulsion aggregation method. Specifically, the toner base particle having the core-shell structure may be obtained by first aggregation, associating, and fusing the particles of the binder resin particle for the core particle and the fine metal particle to produce the core particle, and then adding the binder resin particle for the shell layer into the dispersion of the core particle to agglomerate and fuse the binder resin particle for the shell layer on the surface of the core particle to form a shell layer covering the surface of the core particle. It is preferable that the internal additive to be optionally used is contained in the core particles.

Further, the core particles may be manufactured so as to have a multilayer structure of 2 or more layers made of a binder resin having different compositions. For example, when a binder resin particle having a 3 layer structure is produced, it can be produced by performing a polymerization reaction in which a binder resin is synthesized by dividing into 3 stages of a first stage polymerization (formation of an inner layer), a second stage polymerization (formation of an intermediate layer), and a third stage polymerization (formation of an outer layer). In addition, in each of the polymerization reactions of the first stage polymerization to the third stage polymerization, by changing the composition of the polymerizable monomer, the binder resin particles having a 3 layer configuration having different compositions may be produced. Further, for example, in any one of the first stage polymerization to the third stage polymerization, a synthesis reaction of the binder resin is performed in a state containing an appropriate internal additive such as a releasing agent, so that a binder resin particle having a 3 layer configuration containing an appropriate internal additive may be formed.

(Particle Size of the Toner Base Particle)

The volume average particle diameter of the toner base particles according to the present invention is preferably in the range of 4.5 to 8 μm. It is preferable to have a smaller diameter from the viewpoint of image quality improvement, but when the particle size is small, the adhesion force of the toner base particles increases, and the fluidization degree tends to be low. If the volume average particle diameter of the toner transfer particles is within the above range, the image quality of the output image and the functions of charging, developing, transferring, and cleaning may be made compatible. The particle diameter of the toner base particle is preferably in the range of 5 to 6.2 μm from the above viewpoint, and the dot reproducibility is also enhanced, so that an image of higher image quality may be obtained.

The volume mean particle diameter of the toner base particles may be measured and calculated in the same manner as described above using, for example, a device in which "Multisizer 3 (manufactured by Beckman Coulter)" is connected to a computer system (manufactured by Beckman Coulter) equipped with a data-processing software "Software V3. 51" as a volume-based median diameter (D50%).

As a measurement procedure, 0.02 g of toner base particles are dispersed in 20 mL of a surfactant solution, after acclimation, ultrasonic dispersion is performed for 1 minutes to prepare a toner base particle dispersion. As the above surfactant solution, for example, a solution obtained by diluting a neutral detergent containing a surfactant component 10 times of pure water may be used. This dispersion liquid of toner base particle is dropped into beakers of ISOTONII (manufactured by Beckman Coulter) until the measured density reaches 5 to 10%, and the counts of these beakers are set to 25,000. Here, the aperture diameter of the Multisizer 3 is 100 μm. For the measurement, the frequency is calculated by dividing the range of 2 to 60 μm into 256 parts, and the particle diameter of 50% is obtained as the volume-based median diameter (D50% diameter) from the larger volume integration ratio, and the volume-average particle diameter of the toner base particles is determined.

(Average Circularity of Toner Base Particles)

The circularity of the toner base particles used in the present invention is preferably 0.920 to 1.000 as the average circularity represented by the following Equation (2) from the viewpoint of enhancing the stability of the charging performance and the low-temperature fixing performance. If the degree of circularity of the toner base particle is within the above range, the contact points between the toner base particles are reduced. This improves the external force response and increases the fluidization degree, which is preferable. It should be noted that a sufficient transfer efficiency may be ensured within this range.

Average circularity=(Perimeter of a circle with the same projected area as the particle image)/(Perimeter of the particle projected image) Equation (2):

As a measurement example for obtaining the above average circularity, the measurement using a measuring device of the average circularity "FPIA-2100" (Sysmex Corporation) may be cited. Specifically, the toner base particles are wetted with an aqueous solution of a surfactant, ultrasonic dispersion is performed for 1 minute, and then the toner base particles are dispersed, and then the toner base particles are measured in the HPF (high-magnification imaging) mode under the measurement condition using "FPIA-2100" at appropriate concentrations of 3,000 to 10,000 HPF.

The toner according to the present invention may be obtained by adhering the external additive in the above amount in the step (6) on the surface of the toner base particles obtained in the steps (1) to (5). Specifically, the following method is used as the step (6).

For the external addition and mixing treatment of the external additive to the toner base particle, a mechanical mixing apparatus may be used. As the mechanical mixing device, a Henschel mixer, a Nauta mixer, or a Turbula mixer may be used. Among these, it is preferable to perform a mixing treatment such as increasing the mixing time or increasing the rotational peripheral speed of the stirring blade by using a mixing device capable of applying a shearing force to the particles to be treated like a Henschel mixer. In addition, when a plurality of types of external additives are used, all of the external additives may be mixed together with respect to the toner base particles, or may be divided into a plurality of times and mixed according to the external additive.

Further, as a method of mixing the external additive, for example, the degree of crushing of the external additive is controlled by controlling the mixing strength, that is, the peripheral speed of the stirring blade. The mixing time, and the mixing temperature are controlled by using the above mechanical mixing device. And the adhesion strength may be controlled.

In the above method for producing a toner, it is possible to control the degree of disintegration of the titanic acid compound particles as an external additive and the strength of adhesion to the toner base particles by the above mechanical mixing apparatus and the mixing method.

(Two-Component Developer for Electrostatic Charge Image Development)

In the image forming method of the present invention, the toner of the present invention may be used, for example, as a two-component developer for electrostatic latent image development containing the toner and a carrier. The two-component developer may be obtained, for example, by mixing a toner according to the present invention with a carrier. The mixture apparatus used in mixing is not particularly limited, and examples thereof include a Nauta mixer, a W-cone mixer, and a V-type mixer. The content (toner concentration) of the toner in the two-component developer is not particularly limited, but is preferably 4.0 to 8.0% by mass.

<Carrier>

The carrier is a particle composed of a magnetic material, and a known carrier may be used. For example, the carrier may be a coating type carrier in which a resin coating is applied to the surface of core material particles made of a magnetic substance, or a dispersion type carrier in which a magnetic substance fine powder is dispersed in a resin. The carrier is preferably a coating type carrier from the viewpoint of suppressing adhesion of carriers to the photoreceptor. Hereinafter, the coating type carrier will be described.

(Core Material Composition)

Examples of the carrier core material (magnetic particles) used in the present invention include iron powder, magnetite, various ferrite-based particles, or a resin in which these particles are dispersed. Preferable materials are magnetite and various ferrite particles. As the ferrite, a ferrite containing a heavy metal such as copper, zinc, nickel, manganese, or a light metal ferrite containing an alkali metal and/or an alkaline earth metal is preferable.

Further, it is preferable to contain Sr as a core material. The inclusion of Sr makes it possible to increase the unevenness of the surface of the core material, and even if the core material is coated with resin, the surface is easily exposed and the resistance of the carrier is easily adjusted.

(Shape of Core Material)

The form factor (SF-1) of the core material is preferably 110 to 150. Although it is possible to change the amount of Sr, it is also possible to adjust by changing the sintering temperature of the manufacturing process described later. Here, the shape factor of the core material particles (SF-1) is a numerical value calculated by the following Equation (3).

$$\text{SF-1}=(\text{Maximum length of core particles})^2/(\text{Projected area of core particles})\times(\pi/4)\times 100 \quad \text{Equation (3):}$$

When measuring SF-1 of the core material particles, a carrier is prepared, but when the developer is a two-component developer instead of a carrier alone, a preliminary preparation is performed as follows. Add a two-component developer, a small amount of neutral detergent, and pure water to the beaker to make it fit well, and discard the supernatant liquid while applying a magnet to the bottom of the beaker. In addition, only the carrier is separated by removing the toner and the neutral detergent by adding pure water and discarding the supernatant liquid. Dry at 40° C. to obtain a single carrier.

Subsequently, the coating resin layer is dissolved in a solvent to remove the resin coating layer. 2 g of carrier is charged into a 20 mL glass bottle, and then 15 mL of methyl ethyl ketone is charged into the glass bottle, stirred with a wave rotor for 10 minutes, and the resin coating layer is dissolved with a solvent. The solvent is removed using a magnet, and the core material is further washed 3 times with 10 mL of methyl ethyl ketone. The cleaned core material is dried to obtain a core material. The core material in the present invention is intended to refer to particles after performing this pretreatment.

The core material was randomly photographed with 100 or more particles at a magnification of 150 with a scanning electron microscope, and the photographic image captured by the scanner was measured by an image processing analyzer LUZEX AP (manufactured by Nireco Co., Ltd.). The number average particle diameter is calculated as the average value of the horizontal Ferret diameter, the shape factor is a value calculated by the average value of the shape factor SF-1 calculated by the Equation (3).

(Core Material Particle Size and Magnetization)

The particle size is 10 to 100 μm, preferably 20 to 80 μm, by volume average particle diameter. Further, the magnetization characteristics of the magnetic material itself are preferably $2.5\times10^{-5}$ to $15.0\times10^{-5}$ Wb·m/kgG in terms of saturating magnetization. The volume average particle diameter of the magnetic particles is the volume-based average particle diameter measured by HELOS (manufactured by Sympatec Inc.), a laser regressive grain distribution measuring device with a wet disperser. Saturation magnetization is measured by "DC magnetization characteristic automatic recording device 3257-35" (manufactured by Yokogawa Electric Co., Ltd.).

(Production Method of Core Material)

After the raw material is appropriately weighed, it is pulverized and mixed for preferably 0.5 hours or more, more preferably 1 to 20 hours in a wet media mill, a ball mill or a vibration mill. The pulverized product thus obtained is pelletized using a pressure molding machine, and then calcined preferably at a temperature of 700 to 1200° C., preferably for 0.5 to 5 hours.

Instead of using a pressure molding machine, after pulverizing, water may be added to form a slurry, which may be granulated using a spray dryer. After performing pre-firing, it is further crushed with a ball mill or a vibration mill, and then water and, if necessary, a dispersant, and a binder such as polyvinyl alcohol (PVA) are added to adjust the viscosity, and granulation and a main firing is performed. The temperature of the main firing is preferably at a temperature of 1000 to 1500° C., and the time of the main firing is preferably 1 to 24 hours. When pulverizing after pre-firing, water may be added and pulverized by a wet ball mill, or a wet vibration mill.

Although there is no particular limitation on the pulverizer such as a ball mill or a vibration mill described above, it is preferable to use fine beads having a particle size of 1 cm or less in the medium to be used in order to effectively and uniformly disperse the raw material. Further, by adjusting the diameter, the composition, and the grinding time of the beads to be used, the degree of grinding may be controlled.

The calcined product thus obtained is ground and classified. As a classification method, the particle size is adjusted to a desired particle size by using an existing wind classification method, mesh filtration method, or sedimentation method.

Thereafter, if necessary, the surface is heated at a low temperature to perform an oxide film treatment, whereby resistance adjustment may be performed. For the oxide film process, a general rotary type electric furnace, or a batch type electric furnace may be used, and the heat treatment may be performed at 300 to 700° C., for example. The thickness of the oxide film formed by this process is preferably 0.1 nm to 5 μm. When the thickness of the oxide film is in the above range, the effect of the oxide film layer may be obtained, and the desired characteristics may be easily obtained without excessively high resistance, which is preferable. If necessary, reduction may be performed before the oxidation coating treatment. After the classification, the low magnetic force product may be further separated by a magnetic concentration.

(Coating Resin)

Suitable resins for forming the coating layer of the carrier include polyolefin-based resins such as polyethylene, polypropylene, chlorinated polyethylene, and chlorsulfonated polyethylene; polyvinyl and polyvinylidene resins such as polystyrene, polyacrylates (e.g., polymethylmethacrylate), polyacrylonitrile, polyvinyl acetate, polyvinyl alcohol, polyvinyl butyral, polyvinyl chloride, polyvinylcarbazole, polyvinyl ether, and polyvinylketone; copolymers such as vinyl chloride-vinyl acetate copolymers and styrene-acrylic acid copolymers; silicone resins or modified resins thereof (e.g., alkyd resins, polyester resins, epoxy resins, modified resin by polyurethane); fluorinated resins such as polytetrachloroethylene, polyvinylidene fluoride, polychlortrifluoroethylene; polyamide; polyurethane; polycarbonate amino resins such as urea-formaldehyde resins; and epoxy resins.

Note that preferred is a polyacrylate resin obtained by polymerizing a monomer containing an alicyclic (meth) acrylic ester compound among them. By including such a constitutional unit, the hydrophobicity of the coating material increases, and in particular, the amount of moisture adsorption of the carrier particles decreases under high temperature and high humidity. Therefore, the decrease of the charge amount of the carrier under high temperature and high humidity is suppressed. Further, since the constitutional unit has a rigid annular skeleton, the film strength of the coating material is improved, and the durability of the carrier is improved. Further, a copolymer of an alicyclic (meth) acrylic ester compound and methyl methacrylate is further preferred. This is because, by using methyl methacrylate, the film strength is further increased.

It is preferable that the alicyclic (meth)acrylic ester compound has a cycloalkyl group having 5 to 8 carbon atoms from the viewpoint of mechanical strength, environmental stability of the charge amount (small environmental difference in the charge amount), ease of polymerization, and ease of availability. The alicyclic (meth)acrylic ester compound is preferably at least one selected from the group consisting of cyclopentyl (meth)acrylate, cyclohexyl (meth)acrylate, cycloheptyl (meth)acrylate and cyclooctyl (meth)acrylate. Among them, cyclohexyl (meth)acrylate is preferably contained from the viewpoint of mechanical strength and environmental stability of the charge amount.

In the resin, the content of the constitutional unit derived from the alicyclic (meth)acrylic ester compound is preferably 10 to 100% by mass, and more preferably 20 to 100% by mass. In such a range, the environmental stability and durability of the charge amount of the carrier are further improved. As the number of parts of the resin to be added to the core particles, the range of 1 to and 5 parts is preferable. More preferably it is in the range of 1.5 to 4 parts. If it is too small, it becomes difficult to maintain the charge amount. In addition, when the number is too large, the resistance becomes too high.

(Coverage (Coating) Method)

Specific methods for producing the coating layer include a wet coating method and a dry coating method. Although each method will be described below, the dry coating method is a particularly desirable method for application to the present invention.

Wet coating methods include the following.

(1) Fluidized Bed Spray Coating Method

A method for producing a coating layer by spray coating a coating liquid in which a resin for coating is dissolved in a solvent on a surface of a magnetic particle using a fluidized bed, and then drying the coating liquid.

(2) Dip Coating Method

In a coating liquid in which a resin for coating is dissolved in a solvent, magnetic particles are immersed and subjected to coating treatment, and then dried to prepare a coating layer.

(3) Polymerization Process

Examples thereof include a method in which magnetic particles are immersed in a coating liquid in which a reactive compound is dissolved in a solvent, a coating treatment is performed, and then heat is applied to perform a polymerization reaction, thereby producing a coating layer.

Examples of the dry coating method include the following methods. This is a method in which resin particles are adhered to the surface of the particles to be coated, and thereafter mechanical impact force is applied thereto to melt or soften the resin particles adhered to the surface of the particles to be coated and fix them to produce a coating layer. The carrier core material, the resin, and the low resistance fine particles are agitated at a high speed by using a high-speed agitating mixer capable of applying a mechanical impact force under non-heating or heating, and the mixture is repeatedly applied with an impact force, thereby dissolving or softening the surface of the magnetic particles to produce a fixed carrier.

The coating condition is preferably 80 to 130° C. in the case of heating, the wind velocity causing the impact force is preferably 10 m/s or more during heating, and is preferably 5 m/s or less for suppressing the aggregation of the carrier particles during cooling. As a time for imparting an impact force, 20 to 60 minutes is preferable.

A method of peeling off the resin of the convex portion of the core material by applying stress to the carrier in the coating step or the step after coating of the resin described above and exposing the core material will be described. In the resin coating process in the dry coating method, the resin peeling may be caused by reducing the heating temperature to 60° C. or less and by setting the wind speed at the time of cooling to high speed shear. The post-coverage process may be performed by a forced stirring apparatus, for example, by stirring and mixing using a Turbula mixer, a ball mill, or a vibration mill.

Next, as a method of exposing the core material by moving the resin on the surface of the convex portion to the concave portion side by applying heat and shock to the coating resin, it is effective to lengthen the time for applying the shock force. Specifically, it is preferable to set the amount to 1 and a half hours or more.

(Resistance)

The resistance of the carrier is preferably $1.0\times10^9$ to $1.0\times10^{11}$ Ω·cm, more preferably $1.0\times10^9$ to $5.0\times10^{10}$ Ω·cm. If the resistance is too low, the charged charge as a two-component developer tends to leak. In addition, when the resistance is too high, the rise of the charge tends to be deteriorated during stirring in the developing device.

In the present invention, the resistance of the carrier indicates the initial resistance of the carrier, and is the resistance of the carrier in which the toner is separated from the two-component developer at the start of use of the carrier. The resistance measurement is performed by a resistance measurement method described later. The carrier resistance in the present invention is a resistance that is dynamically measured under development conditions using a magnetic brush. The aluminum electrode drum having the same dimensions as the photoreceptor drum was replaced with the photoreceptor drum, carrier particles were supplied on the developing sleeve to form a magnetic brush, and the magnetic brush was rubbed against the electrode drum, and a voltage (500V) was applied between the sleeve and the drum to measure the current flowing between the two. The resistance of the carrier was determined by the following equation.

$$DVR\ (\Omega CM)=(V/I)\times(N\times L/Dsd)$$

DVR: Carrier resistance (Ωcm)

V: Voltage (V) between developing sleeve and drum

I: Measured current value (A)

N: Developing nip width (cm)

L: Development sleeve length (cm)

Dsd: Distance (cm) between developing sleeve and drum

In the present invention, the measurement is performed at V=500V, N=1 cm, L=6 cm, and Dsd=0.6 mm.

(Carrier Particle Size)

The volume average particle diameter of the carrier is preferably 10 to 100 μm, more preferably 20 to 80 μm. The volume average particle diameter of the carrier may be measured by a laser diffraction particle size distribution "HELOS" (manufactured by Sympatec Inc.) typically equipped with a wet disperser.

[Image Forming System]

The image forming system of the present invention is an image forming system using the toner according to the present invention and the photoreceptor according to the present invention described above, and having at least a charging step, an exposing step, a developing step, and a transferring step. That is, it is a system for forming an image by using the toner according to the present invention in an electrophotographic image forming apparatus (hereinafter, also simply referred to as "image forming apparatus") including a photoreceptor according to the present invention and capable of carrying out each of the above steps. The charging step, the exposing step, the developing step, and the transferring step in the image forming system of the present invention are the same as those described in the image forming method of the present invention described above. An example of an image forming apparatus capable of implementing the image forming system of the present invention will be described below with reference to the drawings.

Figure 3:
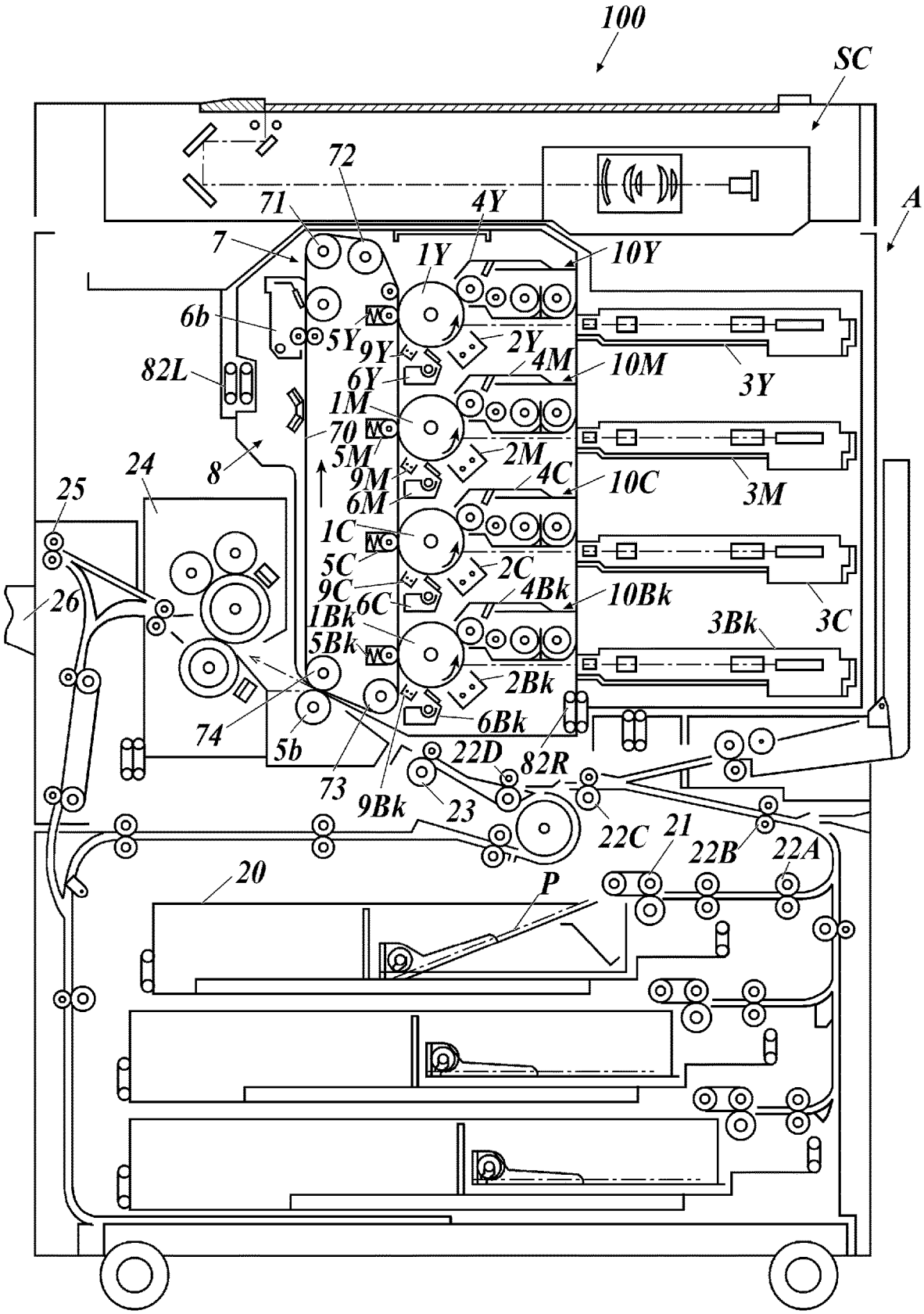
FIG. 3 is a schematic cross-sectional view of an example of an electrophotographic image forming apparatus used in the image forming method of the present invention.

FIG. 3 is a cross-sectional schematic diagram showing a configuration of an example of an image forming apparatus according to the present invention. This image forming apparatus 100 is referred to as a tandem-type color image forming apparatus, and includes four sets of image forming units 10Y, 10M, 10C and 10Bk which are arranged in a column in a vertical direction, an intermediate transfer unit 7, a sheet feeding device 21, and a fixing device 24. An original image reading apparatus SC is disposed above the main body A of the image forming apparatus 100.

The intermediate transfer member unit 7 includes an endless belt-shaped intermediate transfer member 70 rotatable by winding rollers 71, 72, 73, and 74, primary transfer rollers 5Y, 5M, 5C, and 5Bk, and a cleaning device 6*b*.

The four sets of image-forming units 10Y, 10M, 10C and 10Bk each respectively have drum-shaped photoreceptors 1Y, 1M, 1C and 1Bk at the center, and have charging devices 2Y, 2M, 2C and 2Bk arranged around the drum-shaped photoreceptor, exposing devices 3Y, 3M, 3C and 3Bk, rotating developing devices 4Y, 4M, 4C and 4Bk, and cleaning devices 6Y, 6M, 6C and 6Bk for cleaning the photoreceptors 1Y, 1M, 1C and 1Bk. The image forming apparatus 100 includes photoreceptors according to the present invention described above as photoreceptors 1Y, 1M, 1C and 1Bk.

The image forming units 10Y, 10M, 10C and 10Bk form toner images of yellow, magenta, cyan, and black toner images, respectively. In the image forming system of the present invention, the charging step, the exposing step, and the developing step are steps for forming a toner image on the photoreceptor. In the image forming apparatus 100, the charging step, the exposing step, and the developing step are performed as follows using the photoreceptors 1Y, 1M, 1C and 1Bk according to the present invention and the toner according to the present invention on the image forming units 10Y, 10M, 10C, and 10Bk. The toner may be mixed with the carrier as described above and used as a two-component developer.

The image forming units 10Y, 10M, 10C, and 10Bk have the same configuration, except that the colors of the toner images respectively formed on the photoreceptors 1Y, 1M, 1C, and 1Bk differ, and will be described in detail by exemplifying the image forming unit 10Y.

In the image forming unit 10Y, a charging device 2Y, an exposing device 3Y, a developing device 4Y, and a cleaning device 6Y are arranged around a photoreceptor 1Y which is an image forming member, and a yellow (Y) toner image is formed on the photoreceptor 1Y. In the present embodiment, at least the photoreceptor 1Y, the charging device 2Y, the developing device 4Y, and the cleaning device 6Y are integrated in the image-forming unit 10Y.

The charging device 2Y is a means that applies a uniform potential to the photoreceptor 1Y. In the present invention, the charging device may be a roller charging system which is in contact or non-contact.

The exposing device 3Y is a means for performing exposure on the photoreceptor 1Y given a uniform potential by the charging device 2Y on the basis of an image signal (yellow) to form an electrostatic latent image corresponding to the yellow image, and as the exposing device 3Y, an LED in which light emitting elements are arranged in an array in the axial direction of the photosensitive element and an imaging element, or a laser optical system is used.

The developing device 4Y comprises, for example, a developing sleeve having a built-in magnet and rotating while holding a two-component developer, and a voltage applying device for applying a DC and/or AC bias voltage between the photoreceptor 1Y and the developing sleeve.

The cleaning device 6Y is constituted by a cleaning blade in which a tip is provided so as to abut on a surface of the photoreceptor 1Y and a brush roller in contact with a surface of the photoreceptor 1Y disposed at an upstream side of the cleaning blade. The cleaning blade has a function of removing residual toners adhering to the photoreceptor 1Y and a function of rubbing the surfaces of the photoreceptor 1Y.

The brush roller has a function of removing the residual toner adhering to the photoreceptor 1Y, a function of collecting the residual toner removed by the cleaning blade, and a function of rubbing the surface of the photoreceptor 1Y. That is, the brush roller contacts the surface of the photoreceptor 1Y, and in the contact portion, the traveling direction of the brush roller rotates in the same direction as the photoreceptor 1Y to remove the residual toner or paper powder on the photoreceptor 1Y and to convey and collect the residual toner removed by the cleaning blade.

Here, in the photoreceptor according to the present invention, a charge transport material (1) is contained in the photosensitive layer possessed by the photoreceptor, thereby ensuring memory performance. Further, the toner according to the present invention contains titanic acid compound particles as an external additive, whereby the charge amount of the toner is controlled, the adhesion of the toner to the photoreceptor is weakened, the wiping performance at the time of cleaning is secured, and an image forming system excellent in the cleaning performance is provided. As a result, direct damage to the photoreceptor is reduced, and the occurrence of filming due to a decrease in adhesion to the photoreceptor is suppressed. In this way, in the image forming system of the present invention, since the photoreceptor maintains high durability while achieving both cleaning performance and memory performance, a high-quality image may be stably supplied even in long-term use.

In the image forming system using the image forming apparatus 100, the transferring step of transferring the toner image formed on the photosensitive member to the transfer material is a mode in which the toner image is primarily transferred onto the intermediate transfer member using the intermediate transfer member and then the toner image is secondarily transferred onto the transfer material as described below.

The toner images of the respective colors formed by the image forming unit 10Y, 10M, 10C, and 10Bk are sequentially transferred onto the rotating endless belt-shaped intermediate transfer member 70 of the intermediate transfer member unit 7 by the primary transfer rollers 5Y, 5M, 5C, and 5Bk as a primary transfer device, and a synthesized color image is formed. The endless belt-shaped intermediate transfer member 70 is a semi-conductive endless belt-shaped second image carrier which is wound around and rotatably supported by a plurality of rollers 71, 72, 73 and 74.

The color image synthesized on the endless belt-shaped intermediate transfer member 70 is then transferred to a transfer material P such as plain paper or transparent sheet, which is an image support carrying a fixed final image. Specifically, the transfer material P accommodated in the paper feed cassette 20 is fed by the paper feed device 21, and is conveyed to the secondary transfer roller 5*b* as the secondary transfer device via a plurality of intermediate rollers 22A, 22B, 22C, 22D and registration rollers 23. Then, the color image is transferred (secondarily transferred) from the endless belt-shaped intermediate transfer member 70 onto the transfer material P at a time by the secondary transfer roller 5*b*. The transfer material P on which the color image has been transferred is subjected to a fixing process by the fixing device 24, and the transfer material P is pinched by the sheet discharge roller 25 and placed on the sheet discharge tray 26 outside the apparatus.

The fixing device 24 may be, for example, a heat roller fixing method including a heating roller having a heating source therein, and a pressure roller provided in a state of being pressed against the heating roller so that a fixing nip portion is formed on the heating roller.

On the other hand, after the color image is transferred onto the transfer material P by the secondary transfer roller 5*b* as the secondary transfer device, residual toner is removed from the endless belt-shaped intermediate transfer member 70 in which the transfer material P is separated by curvature by the cleaning device 6*b*.

During the image-forming process, the primary transfer roller 5Bk is always in contact with the photoreceptor 1Bk. The other primary transfer rollers 5Y, 5M, and 5C are in contact with the corresponding photoreceptor 1Y, 1M, or 1C only when forming color images. The secondary transfer roller 5*b* comes into contact with the endless belt-like intermediate transfer member 70 only when the secondary transfer is performed by passing the transfer material P therethrough.

In the image forming apparatus 100, a housing 8 including the image forming units 10Y, 10M, 10C, and 10Bk and the intermediate transfer member unit 7 may be pulled out from the apparatus main body A via the support rails 82L and 82R.

Although an image forming system in a color laser printer has been described using the image forming apparatus 100 shown in FIG. 3, the image forming system of the present invention is also applicable to a monochrome laser printer or a copier. The exposure light source may also be a light source other than a laser, for example, an LED light source.

While embodiments of the present invention have been described above, the present invention is not limited to the above-described embodiments, and various modifications may be made.

EXAMPLES

Hereinafter, the present invention will be specifically described with reference to Examples, but the present invention is not limited thereto. In the examples, "parts" or "%" is used, but unless otherwise specified, it indicates "parts by mass" or "% by mass". The "% by mass" may be described as "mass %".

[Production of Toner]

(1) Preparation of Dispersion of Binder Resin Fine Particles

As a dispersion of binder resin fine particles used for producing the toner, a styrene-acrylic resin fine particle dispersion, a crystalline polyester fine particle dispersion, and a non-crystalline polyester fine particle dispersion were prepared by the following method.

[Dispersion of Styrene-Acrylic Resin Fine Particles]

(First Stage Polymerization)

An aqueous solution of a surfactant obtained by dissolving 4 parts by mass of an anionic surfactant consisting of sodium dodecyl sulfate ($C_{10}H_{21}(OCH_2CH_2)_2SO_3Na$) in 3040 parts by mass of ion-exchanged water was charged into a reaction vessel equipped with a stirring device, a temperature sensor, a cooling tube, and a nitrogen-introducing device. Further, a polymerization initiator solution in which 10 parts by mass of potassium persulfate (KPS) was dissolved in 400 parts by mass of ion-exchanged water was added, and the liquid temperature was increased to 75° C.

Next, a polymerizable monomer solution consisting of 532 parts by mass of styrene, 200 parts by mass of n-butyl acrylate, 68 parts by mass of methacrylic acid and 16.4 parts by mass of n-octyl mercaptan was added dropwise over 1 hours. After completion of dropwise addition, polymerization (first stage polymerization) was performed by heating at 75° C. for 2 hours and stirring to prepare a dispersion of styrene-acrylic resin fine particles (1). The weight average molecular weight (Mw) of the styrene-acrylic resin fine particles (1) in the dispersion was 16500.

The weight average molecular weight (Mw) of the resin was determined from the molecular weight distribution measured by gel permeation chromatography (GPC). Hereinafter, the weight average molecular weight (Mw) of the resin is Mw measured by a similar method.

Specifically, a measurement sample was added into tetrahydrofuran (THF) so as to have a concentration of 1 mg/mL, subjected to a dispersion treatment using an ultrasonic disperser at room temperature for 5 minutes, and then treated with a membrane filter having a pore size of 0.2 μm to prepare a sample liquid. Using a GPC device HLC-8120GPC (manufactured by Tosoh Corporation) and a triple column of TSKguardcolumn+TSKgelSuperHZ-m (manufactured by Tosoh Corporation), tetrahydrofuran was flowed as a carrier solvent at a flow rate of 0.2 mL/min while holding the column temperature at 40° C.

Together with the carrier solvent, 10 μL of the prepared sample liquid was injected into the GPC apparatus, and the sample was detected using a refractive index detector (RI detector), and the molecular weight distribution of the sample was calculated using a calibration curve measured using monodisperse polystyrene standard particles. The calibration curve was prepared by measuring 10 polystyrene reference particles (manufactured by Pressure Chemical Co., Ltd.) each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

(Second Stage Polymerization)

A polymerizable monomer solution consisting of 101.1 parts by mass of styrene, 62.2 parts by mass of n-butyl acrylate, 12.3 parts by mass of methacrylic acid and 1.75 parts by mass of n-octyl mercaptan was charged into a flask fitted with a stirring device. Further, a monomer solution (m) was prepared by adding 93.8 parts by mass of paraffin wax HNP-57 (manufactured by Nippon Wax Co., Ltd.) as a releasing agent, and dissolving the internal temperature by warming to 90° C.

In another container, an aqueous surfactant solution in which 3 parts by mass of an anionic surfactant used in the first stage polymerization was dissolved in 1560 parts by mass of ion-exchanged water was charged, and the mixture was heated so that an internal temperature was 98° C. To this aqueous surfactant solution, 32.8 parts by mass (in terms of solid content) of a dispersion of styrene-acrylic resin fine particles (1) obtained by the first stage polymerization was added, and the monomer solution (m) containing the paraffin wax prepared above was further added. A dispersion of emulsified particles (oil droplets) having a particle size of 340 nm was prepared by mixing and dispersing using a mechanical disperser Cleamix (manufactured by M Technique Co., Ltd.) having a circulation path over 8 hours.

To this solution was added a polymerization initiator solution in which 6 parts by mass of potassium persulfate was dissolved in 200 parts by mass of ion-exchanged water. The system was subjected to polymerization (second stage polymerization) by heating and stirring at 98° C. for 12 hours to prepare a dispersion of styrene-acrylic resin fine particles (2). The weight average molecular weight (Mw) of the styrene-acrylic resin fine particles (2) in the dispersion was 23000.

(Third Stage Polymerization)

To a dispersion of styrene-acrylic resin fine particles (2) obtained in the second stage polymerization was added a polymerization initiator solution in which 5.45 parts by mass of potassium persulfate was dissolved in 220 parts by mass of ion-exchanged water. To this dispersion, a polymerizable monomer solution consisting of 293.8 parts by mass of styrene, 154.1 parts by mass of n-butyl acrylate and 7.08 parts by mass of n-octyl mercaptan was added dropwise over a period of 1 hours under a temperature condition of 80° C. After completion of the dropwise addition, polymerization (third stage polymerization) was performed by heating and stirring over 2 hours, and then cooled to 28° C., thereby obtaining a dispersion [1] of styrene-acrylic resin fine particles (3). The weight average molecular weight (Mw) of the styrene-acrylic resin fine particles (3) in the dispersion was 26800.

The volume-based median diameter of the styrene-acrylic fine particles (3) in the dispersions was measured using a particle size distribution "Nanotrack Wave" (manufactured by Microtrack Bell Co., Ltd.) and found to be 230 nm.

[Dispersion of Crystalline Polyester Fine Particles]

To the heated and dried 3-necked flask, 355.8 parts by mass of dodecanedioic acid (1,10-decanedicarboxylic acid) as a polyvalent carboxylic acid monomer, 254.3 parts by mass of 1,9-nonanediol as a polyhydric alcohol monomer, and 3.21 parts by mass of tin ocrylate as a catalyst were added. After venting the air in the container by a reduced pressure operation, an inert atmosphere was created by replacing with nitrogen gas, and reflux treatment was carried out at 180° C. for 5 hours with mechanical stirring. The temperature was gradually increased under the inert atmosphere, and stirring was carried out at 200° C. for 3 hours to obtain a viscous liquid product. Further, while air-cooling, the molecular weight of this product was measured by GPC, and when the weight average molecular weight (Mw) reached 15000, the reduced pressure was released to stop the polycondensation reaction, thereby obtaining a crystalline polyester resin. The obtained crystalline polyester resin had a melting point of 69° C.

Methyl ethyl ketone and isopropyl alcohol were added to a reaction vessel equipped with an anchor blade which gave stirring power. Further, the above-mentioned crystalline polyester resin coarsely pulverized by a hammer mill was gradually added and stirred, and completely dissolved to obtain a polyester resin solution which became an oil phase. A few drops of a dilute aqueous ammonia solution were added to the stirred oil phase, and then the oil phase was added dropwise to ion-exchanged water to emulsify the phase inversion, followed by removal of the solvent while being reduced in pressure in an evaporator. Crystalline polyester resin fine particles were dispersed in the reaction system, and ion-exchanged water was added to the dispersion to adjust the solid content to 20% by mass to prepare a dispersion [1] of crystalline polyester resin fine particles.

When the volume-based median diameter of the crystalline polyester resin fine particles in the dispersion liquid was measured using a particle size distribution measuring instrument "Nanotrack Wave (manufactured by Microtrack Bell Co., Ltd.), it was 173 nm.

[Dispersion of Amorphous Polyester Fine Particles]

A reaction vessel equipped with a stirring device, a nitrogen introduction pipe, a temperature sensor and a rectification column was charged with 139.5 parts by mass of terephthalic acid and 15.5 parts by mass of isophthalic acid as a polyvalent carboxylic acid monomer, and 290.4 parts by mass of a 2,2-bis(4-hydroxyphenyl)propanepropylene oxide 2 molar adduct (molecular weight: 460) and 60.2 parts by mass of a 2,2-bis(4-hydroxyphenyl)propaneethylene oxide 2 molar adduct (molecular weight: 404) as a polyhydric alcohol monomer.

The temperature of the reaction system was increased to 190° C. over 1 hour, and after confirming that the inside of the reaction system was uniformly stirred, 3.21 parts by mass of tin ocrylate was charged as a catalyst. While distilling off the water produced, the temperature of the reaction system was increased from the same temperature to 240° C. over 6 hours, and the dehydration condensation reaction was carried out continuously for 6 hours in a state maintained at 240° C., thereby obtaining an amorphous polyester resin. The obtained amorphous polyester resin had a weight average molecular weight (Mw) of 15000.

By carrying out the same operation as in the preparation of a dispersion of crystalline polyester resin fine particles on the obtained amorphous polyester resin, a dispersion [1] of amorphous polyester resin fine particles having a solid content of 20% by mass was prepared. When the median diameter on the volume basis of the amorphous polyester resin fine particles in the dispersion liquid was measured using a particle size distribution measuring instrument "Nanotrack Wave (manufactured by Micro Microtrack Bell Co., Ltd.), it was 216 nm.

(2) Preparation of Colorant Particle Dispersion

While stirring a solution obtained by dissolving 90 parts by mass of sodium dodecyl sulfate in 1600 parts by mass of ion-exchanged water, 420 parts by mass of a colorant (Seika First Yellow PY-74 (manufactured by Dainippon Seika Co., Ltd.) was gradually added. Then, a "colorant particle dispersion [Y]" was prepared by performing dispersion treatment using a stirring device "Cleamix (manufactured by M Technique Co., Ltd.)".

In the above, a "colorant particle dispersion [M]", "colorant particle dispersion [C]", and "colorant particle dispersion [Bk]" were prepared in the same manner, except that the colorant was changed to SYMULER FAST RED R-269 (manufactured by DIC Corporation), Chromofine Blue PB-15:3 (manufactured by Dainichiseika Co., Ltd.) and Mogul L (manufactured by Cabot Corporation), respectively.

(3) Production of Toner Base Particles

Each of the color toner base particles was produced as follows using the dispersion of the binder resin fine particles obtained above and the colorant particle dispersion.

In a 5-liter stainless steel reactor equipped with a stirrer, a cooling tube and a temperature sensor, 270 parts by mass (in terms of solid content) of the dispersion [1] of styrene-acrylic resin fine particles (3) obtained above, 270 parts by mass (in terms of solid content) of the dispersion [1] of amorphous polyester resin fine particles, 60 parts by mass (in terms of solid content) of the dispersion [1] crystalline polyester resin fine particles, and 48 parts by mass (in terms of solid content) of the colorant particle dispersion liquid [Y] were charged. Further, 380 parts by mass of ion-exchanged water was charged, and the pH was adjusted to 10 using 5 (mol/liter) aqueous sodium hydroxide solution while stirring.

Under stirring, 5.0 parts by mass of a 10% by mass aqueous solution of polyaluminum chloride was added dropwise over 10 minutes, and the internal temperature was increased to 75° C. The particle size was measured using Multisizer 3 (manufactured by Beckman Coulter Co., Ltd., aperture diameter: 50 μm), and at a time point when the volume average particle diameter (volume-based median diameter) reached 5.8 μm, an aqueous sodium chloride solution dissolving 160 parts by mass of sodium chloride in 640 parts by mass of ion-exchanged water was added. Heating with stirring was continued, and when the average circularity reached 0.960 using FPIA-2100 (Sysmex Corporation) the internal temperature was cooled to 25° C. at a rate of 20° C./min.

After cooling, solid-liquid separation was performed using a basket type centrifuge. The resulting wet cake was washed with ion-exchanged water at 35° C. in the same basket type centrifuge until the electrical conductivity of the filtrate was 5 μS/cm. Thereafter, it was transferred to a flash jet dryer (manufactured by Seishin Enterprise Co., Ltd.) and dried until the water content became 0.5 wt %, to obtain a toner base particles [1Y].

In the above, toner base particles [1M], toner base particles [1C], and toner base particles [1Bk] were prepared in the same manner, except that the colorant particle dispersion [Y] was changed to the colorant particle dispersion [M], the colorant particle dispersion [C], and the colorant particle dispersion [Bk], respectively. The toner base particles [1Y], the toner base particle [1M], the toner base particle [1C], and the toner base particle [1Bk] are collectively referred to as toner base particle [1].

(Production of External Additives)

Titanic acid compound particles (s1) to (s7) containing or not containing lanthanum as an external additive were prepared as follows. Further, surface-modified silica particles RX200 were prepared. RX200 were manufactured by Nippon Aerosil Co., Ltd., having a number average primary particle diameter of 12 nm, and surface modification is process with HMDS (hexamethyldisilazane).

(1) Preparation of Titanic Acid Compound Particles (s1) (Surface Modified Lanthanum-Containing Strontium Titanate Particles)

After the metatitanic acid obtained by the sulfuric acid method was subjected to a deironing and bleaching treatment, an aqueous sodium hydroxide solution was added to achieve pH 9.0, and a desulfurization treatment was performed, followed by neutralization to pH 5.8 by hydrochloric acid, then, filtration and water washing was performed. Water was added to the washed cakes to make a slurry of 1.85 mol/L as a $TiO_2$, and then hydrochloric acid was added to make the slurry to be pH 1.0 to perform peptization process. 0.625 mol of this metatitanic acid was taken as a $TiO_2$ and put into a 3-L reaction vessel. After adding 0.719 moles of strontium chloride aqueous solution and lanthanum chloride aqueous solution to the reaction vessel so that the molar ratio of $Sr^{2+}$:$La^{3+}$:$Ti^{4+}$ was 1.00:0.18:1.00, $TiO_2$ density was adjusted to 0.313 mol/L. Next, after warming to 90° C. with stirring and mixing, 296 mL of 5N aqueous sodium hydroxide solution was added over 10 hours, and then stirring was continued for 1 hours at 95° C., and the reaction was terminated.

The reacted slurry was cooled to 50° C., hydrochloric acid was added until pH 5 was 0, and stirring was continued for 1 hours. The obtained precipitate was decanted and washed, hydrochloric acid was added to the slurry containing the precipitate, adjusted to pH 6.5, and 9% by mass of isobutyltrimethoxysilane was added to the solid content to continue stirring and holding for 1 hours. Then, filtration and washing were performed, and the obtained cake was dried in an atmosphere at 120° C. for 8 hours to obtain surface-modified strontium titanate particles as titanic acid compound particles (s1). For the titanic acid compound particles (s1), the number average primary particle diameter determined by the above method using an electron micrograph was 30 nm. The average circularity was 0.85.

(2) Preparation of Titanic Acid Compound Particles (s2) (Surface Modified Lanthanum-Containing Calcium Titanate Particles)

In the method for producing the titanic acid compound particles (s1) described in the above (1), a titanic acid compound particles (s2) were produced in the same manner as the method for producing the titanic acid compound particles (s1), except that a calcium chloride aqueous solution was used instead of the strontium chloride aqueous solution, and the molar ratio of $Ca^{2+}$:$La^{3+}$:$Ti^{4+}$ was set to be 1.00:0.18:1.00. Thus, a surface-modified lanthanum-containing calcium titanate particles were obtained as the titanic acid compound particles (s2). For the titanic acid compound particles (s2), the number average primary particle diameter determined by the above method using an electron micrograph was 30 nm. The average circularity was 0.85.

(3) Preparation of Titanic Acid Compound Particles (s3) (Surface Modified Lanthanum-Containing Magnesium Titanate Particles)

In the method for producing the titanic acid compound particles (s1) described in the above (1), a titanic acid compound particles (s3) were produced in the same manner as the method for producing the titanic acid compound particles (s1), except that a magnesium chloride aqueous solution was used instead of a strontium chloride aqueous solution, and the molar ratio of $Mg^{2+}$:$La^{3+}$:$Ti^{4+}$ was set to be 1.00:0.18:1.00. Thus a surface-modified lanthanum-containing magnesium titanate particles were obtained as the titanic acid compound particles (s3). For the titanic acid compound particles (s3), the number average primary particle diameter determined by the above method using an electron micrograph was 30 nm. The average circularity was 0.85.

(4) Preparation of Titanic Acid Compound Particles (s4) (Surface Modified Lanthanum-Containing Strontium Titanate Particles)

In the production of the titanic acid compound particles (s1) described in the above (1), the titanic acid compound particles (s4) were prepared in the same manner as in the titanic acid compound particles (s1), except that the addition time of the 5N aqueous sodium hydroxide solution was changed to 5 hours. Thus, as the titanic acid compound particles (s4), the surface-modified strontium titanate particles containing lanthanum were obtained.

(5) Production of Titanic Acid Compound Particles (s5) (Surface Modified Lanthanum-Containing Strontium Titanate Particles)

In the production of the titanic acid compound particles (s1) described in the above (1), the titanic acid compound particles (s5) were prepared in the same manner as in the titanic acid compound particles (s1), except that the addition time of the 5N aqueous sodium hydroxide solution was changed to 19 hours. Thus, as the titanic acid compound particles (s5), the surface-modified strontium titanate particles containing lanthanum were obtained.

(6) Preparation of Titanic Acid Compound Particles (s6) (Surface Modified Strontium Titanate Particles)

After the metatitanic acid obtained by the sulfuric acid method was subjected to a deironing and bleaching treatment, an aqueous sodium hydroxide solution was added to achieve pH 9.0, and a desulfurization treatment was performed, followed by neutralization to pH 5.8 by hydrochloric acid, then, filtration and water washing was performed. Water was added to the washed cakes to make a slurry of 1.85 mol/L as a $TiO_2$, and then hydrochloric acid was added to make the slurry to be pH 1.0 to perform peptization process. 0.625 mol of this metatitanic acid was taken as a $TiO_2$ and charged into a 3 L reactor vessel. A total of 0.527 mol of an aqueous solution of strontium chloride was added to the reaction vessel so that the molar ratio of $Sr^{2+}$:$Ti^{4+}$ was 1.00:1.00, and then the concentration of $TiO_2$ was adjusted to 0.313 mol/L. Next, after warming to 90° C. with stirring and mixing, 296 mL of 5N aqueous sodium hydroxide solution was added over 10 hours, and then stirring was continued for 1 hours at 95° C., and the reaction was terminated.

The reaction slurry was cooled to 50° C., then hydrochloric acid was added until the pH reached 5.0, and stirring was continued for 1 hour. The obtained precipitate was decanted and washed, and hydrochloric acid was added to the slurry containing the precipitate, adjusted to pH 6.5, and 9% by mass of isobutyltrimethoxysilane was added based on the solid content, and continued stirring for 1 hour. Then, filtration and washing were performed, and the obtained cake was dried in air at 120° C. for 8 hours to obtain surface-modified strontium titanate particles as titanic acid compound particles (s6). For the titanic acid compound particles (s6), the number average primary particle diameter determined by the above method using an electron micrograph was 30 nm. The average circularity was 0.75.

(7) Preparation of Titanic Acid Compound Particles (s7) (Surface Modified Lanthanum-Containing Strontium Titanate Particles)

In the production of the titanic acid compound particles (s1) described in the above (1), the titanic acid compound particles (s7) were prepared in the same manner as in the titanic acid compound particles (s1), except that the addition time of the 5N aqueous sodium hydroxide solution was changed to 28 hours. Thus, as the titanic acid compound particles (s7), the surface-modified strontium titanate particles containing lanthanum were obtained.

The number average primary particle diameter, average circularity and lanthanum content ratio of the titanic acid compound particles (s1) to (s7) obtained above are shown in Table I below together with the production conditions.

TABLE I

| | Production Conditions | | | | | | Physical properties of particles | | |
|---|---|---|---|---|---|---|---|---|---|
| Titanic acid compound particles | Molar ratio of raw material | | | | | Addition time of sodium hydroxide | Number average primary particle diameter | Average | Containing ratio of lanthanum |
| No. | $Sr^{2+}$ | $Ca^{2+}$ | $Mg^{2+}$ | $La^{3+}$ | $Ti^{4+}$ | (hours) | (nm) | circularity | (mass %) |
| s1 | 1.00 | — | — | 0.18 | 1.00 | 10 | 30 | 0.85 | 8.3 |
| s2 | — | 1.00 | — | 0.18 | 1.00 | 10 | 30 | 0.85 | 8.3 |

TABLE I-continued

| Titanic acid compound particles | Production Conditions: Molar ratio of raw material | | | | | Production Conditions: Addition time of sodium hydroxide | Physical properties of particles: Number average primary particle diameter | Physical properties of particles: Average circularity | Physical properties of particles: Containing ratio of lanthanum |
|---|---|---|---|---|---|---|---|---|---|
| No. | $Sr^{2+}$ | $Ca^{2+}$ | $Mg^{2+}$ | $La^{3+}$ | $Ti^{4+}$ | (hours) | (nm) | | (mass %) |
| s3 | — | — | 1.00 | 0.18 | 1.00 | 10 | 30 | 0.85 | 8.3 |
| s4 | 1.00 | — | — | 0.18 | 1.00 | 5 | 10 | 0.82 | 8.3 |
| s5 | 1.00 | — | — | 0.18 | 1.00 | 19 | 100 | 0.87 | 8.3 |
| s6 | 1.00 | — | — | — | 1.00 | 10 | 30 | 0.75 | 0 |
| s7 | 1.00 | — | — | 0.18 | 1.00 | 28 | 200 | 0.90 | 8.3 |

<Preparation of Toner (1)>

Each of the toner base particles [1] (toner base particles [1Y], [1M], [1C] and [1Bk]), the titanic acid compound particles (s1) and the surface modified silica particles obtained above were added to the Henschel mixer type "FM20C/I" (manufactured by Nippon Coke Industries Co., Ltd.) so that the content (external addition amount) of the titanic acid compound particles (s1) relative to the total amount of toner was 0.5 mass %, and the content of the surface modified silica particles was 0.5 mass %. Next, the rotational speed was set so that the blade tip peripheral speed was 40 m/s, and the resultant was stirred for 15 minutes to perform external addition treatment, thereby producing toners (1Y), (1M), (1C) and (1Bk) of the respective colors. The toners (1Y), (1M), (1C) and (1Bk) are collectively referred to as a toner (1).

<Preparation of Toners (2) to (10)>

In the production of the toner (1), in the same manner as above, except that the types and external addition amounts of titanium dioxide particles were changed as shown in Table II, toners (2) to (10) of each color of Y, M, C, and Bk were produced.

TABLE II

| Toner No. | Toner base particles | External additive: Titanic acid compound particles: No. | Kind | Number average primary particle diameter (nm) | External addition amount (mass %) | Silica particles: Kind | External addition amount (mass %) |
|---|---|---|---|---|---|---|---|
| 1 | Toner base | s1 | La-containing strontium titanate | 30 | 0.5 | RX200 | 0.5 |
| 2 | particles | s2 | La-containing calcium titanate | 30 | 0.5 | | |
| 3 | (1) | s3 | La-containing barium titanate | 30 | 0.5 | | |
| 4 | | s4 | La-containing strontium titanate | 10 | 0.5 | | |
| 5 | | s5 | La-containing strontium titanate | 100 | 0.5 | | |
| 6 | | s1 | La-containing strontium titanate | 30 | 0.1 | | |
| 7 | | s1 | La-containing strontium titanate | 30 | 1.0 | | |
| 8 | | s1 | La-containing strontium titanate | 30 | 1.1 | | |
| 9 | | s6 | Strontium titanate | 30 | 0.5 | | |
| 10 | | s7 | La-containing strontium titanate | 200 | 0.5 | | |

<Preparation of Two-Component Developer>

For each of the colors of the toners (1) to (10) prepared as described above, a ferrite carrier having a volume average particle diameter of 30 μm coated with a copolymer resin (monomer mass ratio=1:1) of cyclohexyl methacrylate and methyl methacrylate was used, and the mixing ratio was set to 6 parts by mass with respect to 100 parts by mass of the carrier, and the ferrite carrier was added to a V-blender under an environment of normal temperature and normal humidity (temperature 10° C., relative humidity 20% RH, temperature 30° C., relative humidity 80% RH). The toner and the carrier were mixed with each other at a rotation speed of the V-blender of 20 rpm and a stirring time of 20 minutes. The mixture was further sieved through a mesh with an opening of 125 μm to produce two-component developers (1) to (10) of each color.

[Production of Photoreceptor]

<Production of Photoreceptor (1)>

A photoreceptor (1) having a layer structure similar to the layer structure of the photoreceptor 1B shown in FIG. 2 was produced in the following manner.

A conductive support [1] was prepared by cutting a surface of an aluminum cylindrical body to make the surface finely roughened.

(Formation of Intermediate Layer)

Binder resin for intermediate layer: 50 parts by mass of polyamide resin "CM8000" (manufactured by Toray Corporation) was added to 1000 parts by mass of mixed solvents of ethanol/n-propyl alcohol/tetrahydrofuran (volume ratio: 45/20/35), and stirred and mixed at 20° C. To this solution, 180 parts by mass of conductive particles 1 (titanium oxide particle 500SAS (manufactured by TAYCA Corporation) were added and dispersed by a bead mill as a mill residence time: 5 hours (1000 rpm). Then, the solution was allowed to stand overnight and then filtered to obtain a coating liquid [1] for forming an intermediate layer.

Filtration was performed under a pressure of 50 kPa using a rigid mesh filter (manufactured by Nippon Pole Co., Ltd.) having a nominal filtration accuracy of 5 μm as a filtration filter.

The coating liquid [1] for forming an intermediate layer thus obtained was applied to the outer peripheral surface of the cleaned conductive support [1] by a dip coating method, and dried at 120° C. for 30 minutes to form an intermediate layer [1] having a dry film thickness of 2 μm.

(Formation of Charge Generating Layer)

24 parts by weight of charge generating material (1:1 adduct of titanylphthalocyanine and (2R,3R)-2,3-butanediol with clear peaks at 8.3°, 24.7°, 25.1°, and 26.5° as measured by Cu-Kα characteristic X-ray diffraction spectra), 12 parts by weight of polyvinylbutyral resin (S-LEC, manufactured by Sekisui Chemical Co., Ltd., "5-LEC" is a registered trademark of the company) and 400 parts by weight of mixed solvent (3-methyl-2-butanone/cyclohexanone=4/1 (V/V)).

The obtained mixed solution was dispersed for 0.5 hours at a circulation flow rate of 40 L/H at 19.5 kHz and 600 W using a circulation type ultrasonic homogenizer "RUS-600TCVP (manufactured by Nippon Seiki Co., Ltd.)", thereby preparing a coating solution for forming charge generating layers [1]. A coating liquid [1] for forming a charge generation layer was applied to the surface of the intermediate layer [1] by a dip coating method, and dried to form a charge generating layer [1] having a thickness of 0.3 μm on the intermediate layer [1].

(Formation of Charge Transport Layer)

A coating liquid [1] for forming a charge transport layer was prepared by mixing and dissolving 60 parts by mass of a compound (CTM-1) which is a charge transport material (1) obtained by the following method as a charge transport agent, 100 parts by mass of a polycarbonate resin (PC resin) (Z300, manufactured by Mitsubishi Gas Chemical Co., Ltd.), and 4 parts by mass of an antioxidant (manufactured by Irganox 1010, BASF Co., Ltd., "IRGANOX" is a registered trademark of the company).

The charge transport layer [1] having a thickness of 24 μm was formed by applying the charge transport layer forming coating liquid [1] to the surface of the charge generating layer [1] by a dip coating method and drying at 120° C. for 70 minutes.

(Production of Compound (CTM-1))

According to the reaction pathway shown in Reaction Scheme (1) above, a compound (CTM-1) was produced by the following steps 1 to 4.

(Step 1)

A 300-ml three-necked flask was charged with palladium acetate (1.12 g, 5 mmol) and heated in an oil bath under nitrogen-flow for 1 hour at 70° C. The temperature of the oil bath was lowered to 50° C., then, t-butylphosphine (1.01 g, 5 mmol, dissolved in 20 ml of toluene) was added and stirred for 30 minutes. After addition of 50 ml of toluene, ditrylamine (9.87 g, 50 mmol), bromoiodobenzene (15.6 g, 55 mmol), and sodium t-butoxide (9.61 g, 100 mmol) were added, then, 100 ml of toluene was added, and the mixture was stirred at 90° C. to 100° C. for 24 hours. After cooling to room temperature, 100 ml of water and ethyl acetate were added, and filtration with celite was performed. The separation procedure was carried out three times with ethyl acetate, and the ethyl acetate layer was dried over anhydrous magnesium sulfate. After concentration of ethyl acetate, a compound (a) was obtained by vacuum drying.

(Step 2)

The compound (a) (10.15 g, 30 mmol), palladium catalyst (1.17 g, 1.44 mmol), dioxaborane (7.62 g, 30 mmol) were placed in a 300 ml three-necked flask, and nitrogen substitution was performed. Then, dimethyl sulfoxide (50 ml) and potassium acetate (8.83 g, 90 mmol) were added under nitrogen substitution. Stirring was carried out at 70 to 80° C. for 6 hours, and after cooling to room temperature, 100 ml of water and ethyl acetate were added, and filtration with celite was carried out. The separation procedure was carried out three times with ethyl acetate, and the ethyl acetate layer was dried over anhydrous magnesium sulfate. After concentration of ethyl acetate, column purification was performed to obtain a compound (b) by vacuum drying.

(Step 3)

To a 300-ml three-necked flask, palladium acetate (0.225 g, 1 mmol) and triphenylphosphine (1.05 g, 4 mmol) were charged and heated to 50° C. in an oil bath under nitrogen flow. 100 ml of toluene was added under nitrogen substitution. The compound (b) (7.99 g, 20 mmol) and 4-bromophenylethane-1-ol (4.02 g, 20 mmol) were added, then aqueous potassium carbonate (8.29 g, 60 mmol) was added, and reflux operation was carried out for 6 hours. After cooling to room temperature, 100 ml of water, ethyl acetate was added and filtration with celite was performed. The separation procedure was carried out three times with ethyl acetate, and the ethyl acetate layer was dried over anhydrous magnesium sulfate. After concentration of ethyl acetate, column purification was performed to obtain a compound (c) by vacuum drying.

(Step 4)

To a 300-ml three-necked flask was charged the compound (c) (5.9 g, 15 mmol) to carry out nitrogen substitution, then 40 ml of dry THF was added and triethylamine (2.02 g, 20 mmol) was added. In an ice-cooled environment, acryloyl chloride (1.81 g, 20 mmol, 10 ml THF solution) was added dropwise and stirred at 10° C. for 1 hour. After returning to room temperature and stirring for an additional 1 hours, 100 ml of water and ethyl acetate were added and filtration with celite was performed. The separation procedure was carried out three times with ethyl acetate, and the ethyl acetate layer was dried over anhydrous magnesium sulfate. After concentration of ethyl acetate, the ethyl acetate was purified by column-drying to obtain a compound (CTM-1).

(Formation of Surface Protective Layer)

15 parts by mass of alumina particles, 100 parts by mass of the compound (M2) as a polymerizable compound, 50 parts by mass of the compound (CTM-1) as a charge transporting substance (1), 10 parts by mass of a polymerization initiator and 320 parts by mass of 2-butanol as a solvent and 80 parts by mass of tetrahydrofuran were mixed and stirred, and sufficiently dissolved and dispersed to prepare a coating liquid [1] for forming a surface protective layer.

The alumina particles were NanoTek (trade name, manufactured by CIK Nanotech Co., Ltd., number-average primary particle diameter: 30 nm), and the polymerization initiator was Irgacure 819 (bis(2,4,6-trimethylbenzoyl)phenylphosphine oxide) manufactured by BASF Co., Ltd.

The coating liquid for forming the surface protective layer [1] was coated on the charge generating layer [1] using a circular slide hopper coating apparatus to form a coating film. The coating film was irradiated with ultraviolet rays for 1 minutes using a metal halide lamp to form a surface protective layer [1] having a dry thickness of 3.0 μm to prepare a photoreceptor (1).

<Production of Photoreceptor (2)>

A photoreceptor (2) was produced in the same manner as in the photoreceptor (1), except that the compound (CTM-30) obtained by the following method was used instead of the compound (CTM-1) as the charge transport material (1) in forming the surface protective layer.

(Production of Compound (CTM-30))

According to the reaction pathway shown in Reaction Scheme (2) above, the compound (CTM-30) was produced by the following steps 1 to 3.

(Step 1)

A 300-ml three-necked flask was charged with palladium acetate (1.12 g, 5 mmol) and heated in an oil bath for 1 hour at 70° C. under nitrogen-flow. The temperature of the oil bath was lowered to 50° C., then t-butylphosphine (1.01 g, 5 mmol, 20 ml toluene solution) was added and stirred for 30 minutes. After addition of 50 ml of toluene, 4-methyl-N-phenylamine (9.17 g, 50 mmol), bromoiodobenzene (15.6 g, 55 mmol), and sodium t-butoxide (9.61 g, 100 mmol) were added, 100 ml of toluene was added, and the mixture was stirred at 90 to 100° C. for 24 hours. After cooling to room temperature, 100 ml of water and ethyl acetate were added and filtration with celite was performed. The separation procedure was carried out three times with ethyl acetate, and the ethyl acetate layer was dried over anhydrous magnesium sulfate. After concentration of ethyl acetate, a compound (d) was obtained by vacuum drying.

(Step 2)

A 300-ml three-necked flask was charged with the compound (d) (10.15 g, 30 mmol), palladium catalyst (1.17 g, 1.44 mmol), and dioxaborane (7.62 g, 30 mmol), and nitrogen substitution was performed. Then 100 ml of dimethyl sulfoxide and potassium acetate (8.83 g, 90 mmol) were added under nitrogen substitution. After stirring at 70 to 80° C. for 6 hours, the mixture was cooled to room temperature, and water and 100 ml of ethyl acetate were added, and filtration with celite was performed. The separation procedure was carried out three times with ethyl acetate, and the ethyl acetate layer was dried over anhydrous magnesium sulfate. After concentration of ethyl acetate, column purification was performed to obtain a compound (e) by vacuum drying.

(Step 3)

A 300-ml three-necked flask was charged with palladium acetate (0.224 g, 1 mmol), triphenylphosphine (1.05 g, 4 mmol) and heated to 50° C. in an oil bath under nitrogen-flow. Under nitrogen substitution, 30 ml of toluene was added. The compound (e) (7.71 g, 20 mmol) and 1-bromo-4-propylbenzene (3.98 g, 20 mmol) were added. Then, an aqueous potassium carbonate solution (8.29 g, 60 mmol) was added and a reflux operation was done for 6 hours. After cooling to room temperature, 100 ml of water and ethyl acetate were added and filtration with celite was performed. The separation procedure was carried out three times with ethyl acetate, and the ethyl acetate layer was dried over anhydrous magnesium sulfate. After concentration of ethyl acetate, the ethyl acetate was purified by column to obtain a compound (CTM-30) by vacuum drying.

<Production of Photoreceptors (3) and (4)>

In forming the surface protective layer, the photoreceptors (3) and (4) were produced in the same manner as the photoreceptor (1), except that silica particles RX50 (trade name, manufactured by Nippon Aerosil Co., Ltd., number average primary particle diameter: 40 nm) and titania particles NanoTek (trade name, manufactured by CIK Nanotech Co., Ltd., number average primary particle diameter: 20 nm) were used instead of the alumina particles, respectively.

<Production of Photoreceptor (5)>

In the photoreceptor (1), a photoreceptor (5) having a layer structure similar to the layer structure of the photoreceptor 1A shown in FIG. 1 was manufactured without forming a surface protective layer.

<Production of Photoreceptor (6)>

A photoreceptor (6) was manufactured in the same manner as in the photoreceptor (1), except that alumina particles were not added in the formation of the surface protective layer.

<Production of Photoreceptor (7)>

A photoreceptor (7) was manufactured in the same manner as in the photoreceptor (1), except that the charge transport material (1) was not added in the formation of the surface protective layer.

Table III shows the main constituent materials of the charge transport layer and the surface protective layer of the photoreceptors (1) to (7). In Table III, "1B" of the layer structure of the photoreceptor indicates that the layer structure is the same layer structure as that of the photoreceptor 1B shown in FIG. 2, and "1A" indicates that the layer structure is the same layer structure as that of the photoreceptor 1A shown in FIG. 1.

TABLE III

| | | Charge transport layer | | Surface protective layer | | | |
|---|---|---|---|---|---|---|---|
| | | | | | | Metal oxide particles | |
| Photoreceptor No. | Layer structure of photoreceptor | Charge transport material | Binder resin | Charge transport material | Polymerizable compound | Kind | Particle diameter (nm) |
| 1 | 1B | CTM-1 | PC resin (Z300) | CTM-1 | M2 | Alumina | 30 |
| 2 | 1B | | | CTM-30 | M2 | Alumina | 30 |
| 3 | 1B | | | CTM-1 | M2 | Silica | 40 |
| 4 | 1B | | | CTM-1 | M2 | Titania | 20 |
| 5 | 1A | | | | | None | |
| 6 | 1B | | | CTM-1 | M2 | — | — |
| 7 | 1B | | | — | M2 | Alumina | 30 |

Example 1

Using the photoreceptor (1) and the two-component developer (1) prepared above, image formation was performed. As the image forming apparatus, similarly to the image forming apparatus shown in FIG. 3, a tandem-type color image forming apparatus "bizhub C554" (manufactured by Konica Minolta Business Technologies, Inc.) having four sets of image forming units corresponding to toners of four colors of Y, M, C, and Bk was used, and an image forming apparatus (1) in which all four photoreceptors of the image forming apparatus were replaced with photoreceptors (1). The two-component developer (1) was introduced into the developing device of the image forming unit corresponding to the four colors of the image forming apparatus (1).

<Evaluation>

Using the image forming apparatus (1) into which the above-mentioned two-component developer (1) was introduced, image formation was conducted for performing the following evaluations (1) to (3), and the cleaning performance, memory performance, and wear resistance were determined. The evaluation results are shown in Table IV.

(1) Evaluation of Cleaning Performance

Using the image forming apparatus (1) into which the two-component developer (1) was introduced, an image forming test was conducted in which 2000 sheets of a chart having a printing rate of 5% were printed at a Bk position under conditions of a room temperature of 23° C. and a humidity of 50%. The number of deposits on the surface of the photoreceptor (1) at the Bk position after the image formation test was observed by a microscope in a field of view of 20 mm×40 mm, and evaluated by the following criteria.

(Evaluation Criteria)

AA: No deposits are seen (very good).

BB: 1 to 5 deposits (good).

CC: 6 to 10 deposits (no problems in practical use).

DD: 11 or more deposits (problems in practical use).

(2) Evaluation of Memory Performance

Using the image forming apparatus (1) into which the two-component developer (1) was introduced, five consecutive memory detection charts (charts having two solid image portions in one sheet) were output in an LL environment (temperature 10° C. and humidity 20%). The solid image portions of the two in one of the resulting fifth output image was visually compared and evaluated according to the following criteria. If the evaluation AA, BB, or CC, there is no problem in practical use.

(Evaluation Criteria)

AA: No density difference is observed.

BB: Weak density difference is visually observed.

CC: Density difference can be visually observed.

DD: Density difference is clearly observed.

(3) Evaluation of Wear Resistance

Using the image forming apparatus (1) into which the two-component developer (1) was introduced, an image forming test was conducted in which 100000 sheets of character charts of 5% of each color of Y, M, C, and Bk were continuously printed in an NN environment (temperature: 23° C. and humidity: 50%). The amount of depletion of the photoreceptor (1) at the Bk position after the image formation test was confirmed by the following method.

The initial film thickness (μm) of the laminated film of the photoreceptor (the laminated film consisting of the intermediate layer, the charge generation layer, the charge transport layer, and the surface protective layer) before the start of the image forming test was measured, and the film thickness (μm) after the end of the image forming test was measured to calculate the difference ΔT (μm) between the film thicknesses of the laminated films of the photoreceptor before and after the image forming test. The film thickness of the laminated film of the photoreceptor was measured at 10 locations at random at uniform film thickness portions (except for at least 3 cm at both ends of the photoreceptor because both ends of the photoreceptor tend to have uneven film thickness), and the average value thereof was set as the film thickness of the laminated film of the photoreceptor. As the film thickness measuring instrument, an eddy current method film thickness measuring instrument "EDDY560C" (manufactured by Helmut Fisher Co.) was used. The difference ΔT (μm) between the film thicknesses before and after the image forming test was converted to 100 krot (100,000 rotations) of the photoreceptor to obtain an α value (μm per 100,000 rotations), which was used as the amount of depletion of the photosensitive member. The obtained α value was used to evaluate the abrasion resistance on the following reference.

(Evaluation Criteria)

AA: α value≤0.1 (very good)

BB: 0.1<α≤0.2 (good)

CC: 0.2<α≤0.3 (no problem in practical use)

DD: 0.3<α (problems in practical use)

Examples 2 to 13

In Example 1, image formation was performed in the same manner as in Example 1, except that the photoreceptor and the two-component developer were changed as shown in Table IV, and evaluations of cleaning performance, memory performance, and wear resistance of Examples 2 to 13 were performed. The evaluation results are indicated in the table IV. In Table IV, the number of the two-component developer is not listed, but the number of the two-component developer is the same as the number of the toner.

TABLE IV

| | Photoreceptor | | | | Two-component developer | | | External addition amount (mass %) | | | | | |
|---|---|---|---|---|---|---|---|---|---|---|---|---|---|
| | | Charge transport layer | Surface protective layer | | | Titanic acid compound particles | | | | | Wear resistance | | |
| | Photoreceptor No. | Charge transport material | Charge transport material | Metal oxide particles | Toner No. | No | Particle diameter (nm) | External addition amount (mass %) | Cleaning performance | Memory performance | αvalue | Evaluation | Remarks |
| Example 1 | 1 | CTM-1 | CTM-1 | Alumina | 1 | s1 | 30 | 0.5 | AA | AA | 0.05 | AA | Present Invention |
| Example 2 | 2 | | CTM-30 | Alumina | 1 | s1 | 30 | 0.5 | AA | AA | 0.07 | AA | Present Invention |
| Example 3 | 1 | | CTM-1 | Alumina | 2 | s2 | 30 | 0.5 | BB | AA | 0.08 | AA | Present Invention |
| Example 4 | 1 | | CTM-1 | Alumina | 3 | s3 | 30 | 0.5 | BB | AA | 0.12 | BB | Present Invention |
| Example 5 | 1 | | CTM-1 | Alumina | 4 | s4 | 10 | 0.5 | BB | AA | 0.10 | AA | Present Invention |
| Example 6 | 1 | | CTM-1 | Alumina | 5 | s5 | 100 | 0.5 | AA | AA | 0.16 | BB | Present Invention |
| Example 7 | 1 | | CTM-1 | Alumina | 6 | s1 | 30 | 0.1 | BB | AA | 0.06 | AA | Present Invention |
| Example 8 | 1 | | CTM-1 | Alumina | 7 | s1 | 30 | 1.0 | BB | AA | 0.15 | BB | Present Invention |
| Example 9 | 3 | | CTM-1 | Silica | 1 | s1 | 30 | 0.5 | BB | BB | 0.09 | AA | Present Invention |

TABLE IV-continued

| | Photoreceptor | | | | Two-component developer | | | | External addition amount (mass %) | | | | |
|---|---|---|---|---|---|---|---|---|---|---|---|---|---|
| | Photoreceptor No. | Charge transport layer: Charge transport material | Surface protective layer: Charge transport material | Surface protective layer: Metal oxide particles | Toner No. | No | Titanic acid compound particles: Particle diameter (nm) | External addition amount (mass %) | Cleaning performance | Memory performance | Wear resistance: αvalue | Wear resistance: Evaluation | Remarks |
| Example 10 | 4 | | CTM-1 | Silica | 1 | s1 | 30 | 0.5 | AA | BB | 0.07 | AA | Present Invention |
| Example 11 | 5 | | — | — | 1 | s1 | 30 | 0.5 | BB | AA | 0.30 | CC | Present Invention |
| Example 12 | 6 | | CTM-1 | — | 1 | s1 | 30 | 0.5 | AA | AA | 0.20 | BB | Present Invention |
| Example 13 | 1 | | CTM-1 | Alumina | 9 | s6 | 30 | 0.5 | BB | AA | 0.25 | CC | Present Invention |

From Table IV, it can be seen that in the image forming method of the present invention, the photoreceptor can maintain high durability while achieving both cleaning performance and memory performance, so that a high-quality image may be stably supplied even in long-term use.

What is claimed is:

1. An image forming method using a toner for developing an electrostatic charge image and an electrophotographic photoreceptor, and comprising at least a charging step, an exposing step, a developing step and a transferring step, wherein the electrophotographic photoreceptor has a photosensitive layer, and the photosensitive layer contains a compound having a structure represented by the following Formula (1) as a charge transport material, and the toner for developing an electrostatic charge image contains at least titanic acid compound particles as an external additive, Formula (1)

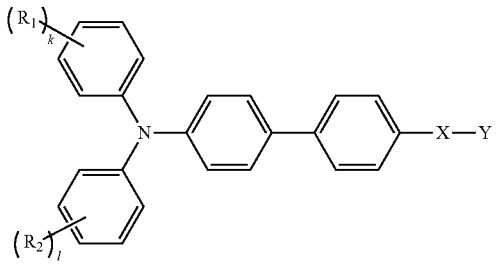

in Formula (1), $R_1$ and $R_2$ each independently represent an alkyl group having 1 to 7 carbon atoms or an alkoxy group having 1 to 7 carbon atoms; k and l each independently represent an integer of 0 to 5; X represents a single bond or an alkylene chain; Y represents a hydrogen atom, an alkyl group having 1 to 7 carbon atoms, an alkoxy group having 1 to 7 carbon atoms or a substituent having a reactive group; and $R_1$ may be the same or different when k is 2 or more, and $R_2$ may be the same or different when l is 2 or more.

2. The image forming method described in claim 1, wherein the titanic acid compound particles contain lanthanum.

3. The image forming method described in claim 1, wherein X of Formula (1) is a group having a structure represented by the following Formula (2), and Y is a hydrogen atom, an alkyl group having 1 to 7 carbon atoms, an alkoxy group having 1 to 7 carbon atoms, or a group having a structure represented by the following Formula (3) or formula (4), Formula (2)

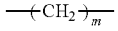

in Formula (2), m represents an integer of 0 to 5,

Formula (3)

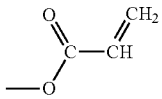

Formula (4)

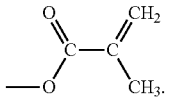

4. The image forming method described in claim 1, wherein the titanic acid compound particles are selected one from the group consisting of strontium titanate particles, calcium titanate particles, magnesium titanate particles, and barium titanate particles.

5. The image forming method described in claim 1, wherein a number average primary particle diameter of the titanic acid compound particles is in the range of 10 to 100 nm.

6. The image forming method described in claim 1, wherein a content of the titanic acid compound particles is in the range of 0.1 to 1.0% by mass with respect to the total amount of the toner for developing an electrostatic charge image.

7. The image forming method described in claim 1, wherein the photosensitive layer comprises a plurality of layers, and contains a compound having a structure represented by Formula (1) in an outermost layer of the photosensitive layer.

8. The image forming method described in claim 7, wherein the outermost layer is a layer obtained by curing a composition containing a polymerizable compound and the compound having a structure represented by Formula (1).

9. The image forming method described in claim 7, wherein the outermost layer contains at least one selected from the group consisting of silica particles, tin oxide particles, titania particles, and alumina particles.

10. An image forming system using a toner for developing an electrostatic charge image and an electrophotographic photoreceptor, and having at least a charging step, an exposing step, a developing step and a transferring step, wherein the image forming system performs the image forming method described in claim 1.

* * * * *